US011891805B2

(12) United States Patent
Cavasinni

(10) Patent No.: US 11,891,805 B2
(45) Date of Patent: Feb. 6, 2024

(54) PANEL MOUNTING SYSTEM

(71) Applicant: CSR Building Products Limited, North Ryde (AU)

(72) Inventor: Daniel Cavasinni, Ingleburn (AU)

(73) Assignee: CSR Building Products Limited, North Ryde (AU)

( * ) Notice: Subject to any disclaimer, the term of this patent is extended or adjusted under 35 U.S.C. 154(b) by 303 days.

(21) Appl. No.: 17/416,010

(22) PCT Filed: Dec. 10, 2019

(86) PCT No.: PCT/AU2019/051350
§ 371 (c)(1),
(2) Date: Jun. 18, 2021

(87) PCT Pub. No.: WO2020/124131
PCT Pub. Date: Jun. 25, 2020

(65) Prior Publication Data

US 2022/0074203 A1 Mar. 10, 2022

(30) Foreign Application Priority Data

Dec. 18, 2018 (AU) ..... 2018904819
Apr. 12, 2019 (AU) ..... 2019901268

(51) Int. Cl.
*E04B 9/28* (2006.01)
*E04B 9/00* (2006.01)
(Continued)

(52) U.S. Cl.
CPC ..... *E04B 9/28* (2013.01); *E04B 9/006* (2013.01); *E04B 9/064* (2013.01); *E04B 9/183* (2013.01);
(Continued)

(58) Field of Classification Search
CPC . E04B 9/28; E04B 9/366; E04B 9/006; E04B 9/064; E04B 2009/062
See application file for complete search history.

(56) References Cited

U.S. PATENT DOCUMENTS 3,067,323 A 12/1962 Kember
3,696,571 A * 10/1972 Schluter ..... E04B 9/34 52/506.06
(Continued)

FOREIGN PATENT DOCUMENTS

CN 102900193 A 1/2013
EP 3073021 A1 9/2016
(Continued)

OTHER PUBLICATIONS

1 European Patent Office Extended Search Report for Application No. 19900931.7 dated Feb. 18, 2022 (8 pages).
(Continued)

*Primary Examiner* — Adriana Figueroa
(74) *Attorney, Agent, or Firm* — Michael Best & Friedrich LLP

(57) ABSTRACT

Disclosed is a system and method for mounting a panel (40) such as an acoustic panel, baffle or fin. The system for mounting the panel (40) can comprise an elongate member (12). A base (14) of the member (12) can be configured to enable it to be mounted with respect to a structure. Opposing sidewalls (13) of the member (12) can extend from the base (14) such that, in profile, the sidewalls define a neck portion (N) that extends to an enlarged head portion (H) of the member (12). The panel (40) can have a recess (42) formed in an edge thereof. The recess (42) can be configured to generally correspond to an external profile of the member (12). An inner recess portion (43) of the panel (40) can be enlarged to receive the member head portion (H), with an outer recess portion (45) being configured to receive the
(Continued)

member neck portion (N). The outer recess portion (45) can open out of the panel edge such that, when the member (12) is located in the panel recess (42) it retains the panel (40) to the member (12).

20 Claims, 16 Drawing Sheets

(51) Int. Cl.
*E04B 9/06* (2006.01)
*E04B 9/18* (2006.01)
*E04B 9/36* (2006.01)

(52) U.S. Cl.
CPC ..... *E04B 9/366* (2013.01); *E04B 2009/062* (2013.01)

(56) References Cited

U.S. PATENT DOCUMENTS

| | | | | |
|---|---|---|---|---|
| 10,352,045 | B2 * | 7/2019 | Pattabhi | E04B 9/067 |
| 2015/0167297 | A1 | 6/2015 | St-Laurent et al. | |

FOREIGN PATENT DOCUMENTS

| | | | |
|---|---|---|---|
| GB | 584421 | | 1/1947 |
| JP | 3172917 | U | 1/2012 |
| KR | 101407195 | B1 | 6/2014 |
| KR | 101443558 | B1 | 9/2014 |
| WO | 2007012077 | A2 | 1/2007 |
| WO | 2011104501 | A2 | 9/2011 |

OTHER PUBLICATIONS

International Search Report and Written Opinion for Application No. PCT/AU2019/051350 dated Mar. 13, 2020 (13 pages).
International Preliminary Report on Patentability for Application No. PCT/AU2019/051350 dated Jan. 8, 2021 (6 pages).
Indian Patent Office Action for Related Application No. 202117031991 dated Aug. 10, 2022 (6 pages).

* cited by examiner

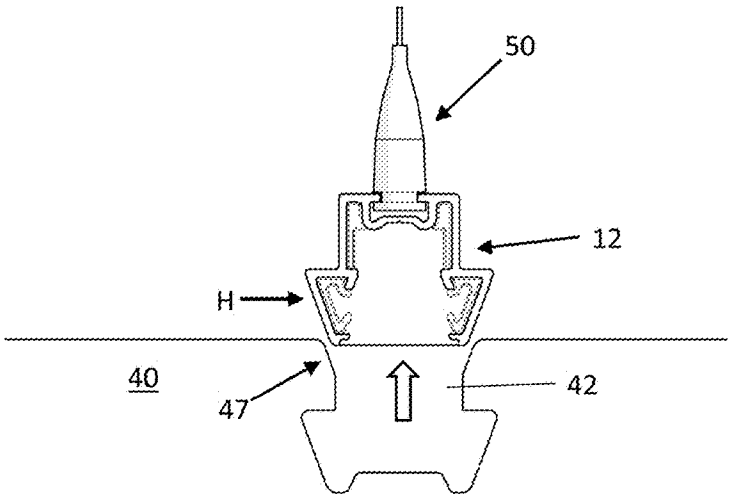
Figure 19C
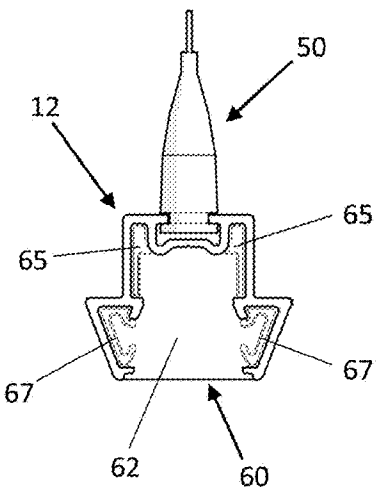
Figure 19B
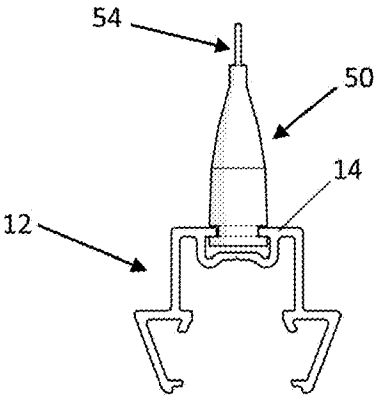
Figure 19A
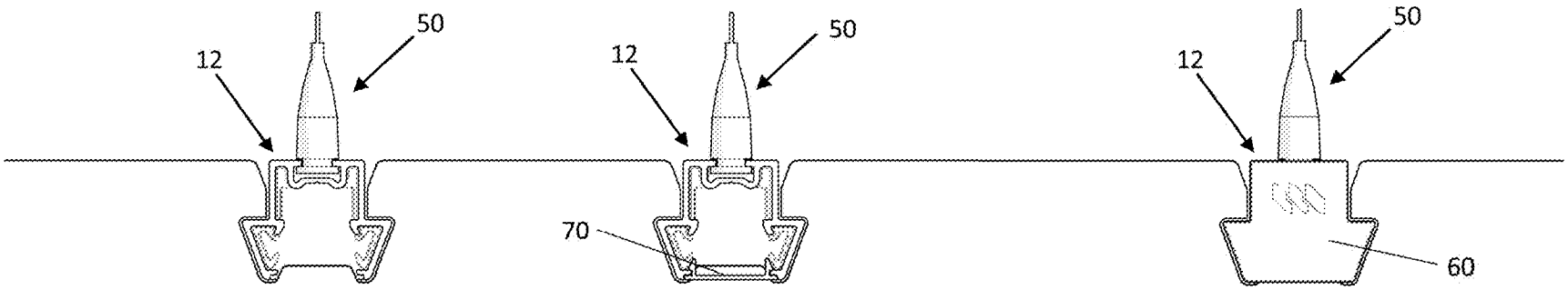
Figure 19F
Figure 19E
Figure 19D

PANEL MOUNTING SYSTEM

TECHNICAL FIELD

This disclosure relates to a system for mounting panels (e.g. for mounting panels/fabrics which can provide an acoustic solution such as acoustic panels, baffles, fins, blades and fabrics). Hereafter, such acoustic panels, baffles, fins blades and fabrics will collectively be referred to as "panels". The panels may be mounted as a ceiling fixture, suspension or infill and/or may optionally be mounted to provide for different lighting effects. The panels may additionally or alternatively be mounted to form walls, partitions, borders, dividers, etc.

BACKGROUND ART

Acoustic insulation panels (e.g. panels, baffles, fins, blades, fabrics) are employed for various acoustic applications ranging from sound absorption, sound attenuation and reduction of acoustic reverberation. Such panels can be employed as cavity and ceiling infill products to reduce sound transmission through walls and ceilings and within rooms and large spaces. Such panels can also form walls, partitions, borders, dividers, etc. within rooms and large spaces. Acoustic panels can be used in various building types and applications including in offices, meeting rooms, educational facilities including lecture theatres and classrooms, theatres and entertainment venues, restaurants, libraries, live venues, sports venues and halls, residential apartments, health (e.g. hospital) and aged-care facilities, as well as in various commercial applications.

At present, there is no universal mounting system for acoustic insulation panels. In addition, existing mounting systems tend to be of metal (e.g. aluminium and steel) and are thus relatively heavy and/or labour intensive to install. Further, acoustic panel installation tends to be bespoke, with there being very few modular installation systems available.

It is to be understood that, if any prior art is referred to herein, such reference does not constitute an admission that the prior art forms a part of the common general knowledge in the art, in Australia or any other country.

SUMMARY

Disclosed herein, in a first aspect, is a system for mounting a panel with respect to a structure (e.g. a ceiling, ceiling space, false ceiling, wall, frame, divider, partition, border, fixture, furniture, etc.). The panel can take the form of an acoustic panel, baffle, fin, blade or fabric but is not so limited.

The system of the first aspect comprises an elongate member. A base of the member is configured to enable it to be mounted with respect to the structure. Opposing sidewalls of the member extend from the base such that, when the member is viewed in profile (i.e. from the member end), the sidewalls are configured to define a neck portion that extends to an enlarged head portion of the member.

The elongate member typically takes the form of a channel (e.g. so that it may be formed as an elongate extrusion, such as from a metal, composite or plastic). However, in a variation, the elongate member may have a solid form (e.g. to have a rod-like or bar-like form) or may be of closed hollow section, but in each case the member still has the neck portion and enlarged head portion. In these latter cases the sidewalls and base can define respective sides/surfaces of the solid form or hollow section.

The system of the first aspect also comprises a panel. As above, typically the panel takes the form of an acoustic panel, baffle or fin. The panel has at least one recess formed in an edge thereof (e.g. to be located in an in-use upper edge when the panel is to be suspended, or in an in-use side edge when the panel is to be used as a divider, barrier, etc.). The at least one recess is configured to generally correspond to an external profile of the member. Thus, the recess can be provided with an inner recess portion that is enlarged to receive (e.g. snugly or closely) the member head portion. The recess can also be provided with an outer recess portion that is configured to receive (e.g. snugly or closely) the member neck portion. The outer recess portion opens out of the panel edge (e.g. to enable the member to be mounted with respect to the structure). In use, when the member is located in the panel recess, it is transverse to the panel and retains the panel to the member.

For example, one or both of the member and panel may be configured whereby the member can be slid laterally through the recess to retain the panel to the member. Additionally or alternatively, one or both of the member and panel may be configured whereby the member can be push-fit into the recess, via the open outer recess portion, to retain the panel to the member.

The panel can be configured to be mounted to each member in a generally orthogonal arrangement (e.g. each panel extends at a right angle to the longitudinal axis of each member). Alternatively, the panel can be configured to mount at an angle to each member (e.g. each panel extends at an angle other than ~90° to the longitudinal axis of each member). Further, each member need not be straight, and may e.g. be curved.

The system of the first aspect can provide for "universal" panel mounting. In this regard, the system can accommodate a range of panel widths (e.g. ranging from 4 mm to 150 mm panel thicknesses). The system can also accommodate a range of panel lengths (e.g. multiple spaced members can be mounted with respect to the structure to support long panels). The member may be direct-fixed to the structure or may be suspended or spaced from the structure. Thus, the system can allow for quick and easy installation. The system may be factory prefabricated and may be supplied as a kit e.g. along with installation instructions. A kit may be supplied without panels. For example, preformed panels may be supplied separately to other components of the mounting system.

The system of the first aspect can be modular in that members and panels can each easily be adapted on site to suit the particular application, including by using member end caps and connectors, as outlined below. In some forms, as outlined below, the system of the first aspect may integrate lighting. In some forms, as outlined below, the member may also directly support there-within a panel in the form of a fin.

When the elongate member takes the form of an elongate channel, a base of the channel may be configured to be mounted with respect to the structure (e.g. to be direct-mounted to, or suspended or spaced from, the structure). The opposing spaced sidewalls of the channel can extend from the base to define the channel.

Typically, the channel is configured such that the base extends between and joins the channel sidewalls. Each sidewall may then extend to a distal end edge such that the sidewalls are spaced apart to define an opening to the channel. However, in a variation of the channel, the base may instead be defined by elongate, spaced base walls, whereby an opening between the base walls can be defined along the length of the base. In this variation, the channel sidewalls may be connected (e.g. as a continuous wall) instead of being spaced apart at their distal end edges.

In an embodiment, when the elongate channel is viewed in profile (i.e. from an end thereof), each channel sidewall may be configured to define an outwardly projecting step-formation at the juncture of the neck portion with the head portion. For example, a neck portion of the sidewall may extend generally orthogonally from the base to the step-formation. The step-formation may then comprise a step that projects out (e.g. laterally) from a neck portion of the sidewall. Then, a head portion of each sidewall may extend from its respective step (e.g. it may extend so as to form an acute angle with its respective step). The head portion of each sidewall may extend to a distal end edge of the sidewall. Alternatively, the head portion of each sidewall may extend such that the sidewalls are connected (e.g. as a continuous wall) instead of being spaced at their distal end edges.

In an embodiment, sides of the panel recess may also be configured to define corresponding inwardly projecting step-formations. The corresponding step-formations may be defined at the juncture of the inner recess portion with the outer recess portion. Thus, when the channel is located in the panel recess, the corresponding channel and panel step-formations may face each other (e.g. they may abut) to thereby retain the panel to the channel.

In an embodiment, each sidewall distal end edge may comprise an inwardly projecting lip that runs for a length of the sidewall (e.g. for the entire length or along discrete length(s) of the sidewall). For example, the lips may project towards each other. The lips may be configured to retain an elongate (e.g. strip-like) cover at an opening to the channel, such as by a snap- or slide-fit.

When the elongate cover is in the form of an elongate strip, it may be provided with a pair of elongate, spaced parallel flanges that project from and extend along a face thereof. A distal end edge of each such flange may be configured to interact with (e.g. by a snap- or slide-fitting) a respective formation defined at a corresponding distal end edge of each sidewall. In this way, the elongate cover can be readily retained at and thereby cover the opening to the channel. The elongate cover may be formed of the same material as the channel (e.g. a metal such as aluminium), and thus may comprise be opaque. The elongate cover may instead be formed of a different material to the channel (e.g. a light-transmissive and/or polymeric material such as PVC, polycarbonate, etc). When formed of a light-transmissive material (e.g. a translucent or transparent material such as a polymer), this can allow the channel to hold a source of light (e.g. an LED strip) and thereby release light in use (e.g. the released light can pass through the cover and fall onto and/or reflect from panel(s) or fabric mounted to the channel).

In an embodiment, an external side of the base (i.e. the side that typically faces the structure) may comprise an inwardly formed elongate recess. This recess may open out from the base, which can allow for a suitable fastening mechanism to be connected to the base. The opening to the base recess may be further defined by opposing and inwardly projecting lips that extend for a length of the base recess (e.g. for the entire length or for discrete portion(s) of the base recess). These lips can be employed to secure the suitable fastening mechanism.

In this regard, in an embodiment, the system of the first aspect may further comprise a mounting fixture (i.e. the mounting fixture can provide one such suitable fastening mechanism). The mounting fixture may be configured for mounting to the structure (e.g. directly or to be suspended/spaced therefrom).

A portion of the mounting fixture may be configured to locate within the base recess and be retained therein by the lips. For example, the mounting fixture may be elongate, with one end of the elongate mounting fixture being configured for mounting with respect to the structure. This one end may be directly mounted to (e.g. by being affixed within) the structure. Alternatively, this one end may be configured to be suspended or spaced from the structure (e.g. via a wire, rod, etc.). Further, this one end of the mounting fixture may be located at that portion of the mounting fixture that is located (i.e. protrudes) outside of the base recess in use (i.e. the mounting fixture can project away from the base in use).

The other end of the mounting fixture may be provided with a groove therein (e.g. a peripherally extending groove formation). The groove enables the other end of the mounting fixture to locate within the base recess—e.g. to be retained therein by the lips locating in the groove.

In an embodiment, a wall of the base recess may be countersunk on an opposite side of the wall to the base recess. The countersunk side may extend for a length of the base recess wall (e.g. for the entire length or for discrete length(s) of the wall). An LED strip light may be located in the countersunk side. The countersunk side may also be configured to have one or more fasteners secured thereat (e.g. for direct mounting of the base to the structure). Each fastener may pass through a respective aperture formed in the base recess wall, which aperture may also be countersunk to flush-mount a head of the fastener therein. In this way, the LED strip light may still be located in the countersunk side (i.e. the LED strip may cover each fastener head).

In an embodiment, each sidewall may further comprise an elongate flange that projects inwardly from an intermediate location of a respective sidewall. Each such flange may extend for a length of a main channel recess (e.g. for the entire length or for discrete section(s) of the main channel recess). The flanges may generally project towards each other. In an embodiment, each flange may be formed as a continuation of the step of the step-formation.

In an embodiment, each flange may comprise a lip that extends at an acute angle from a distal end edge of the flange and away from the base. In use, the spacing of the distal end edges of the flanges may be such that an elongate edge of panel, such as an acoustic fin, can be positioned between and be retained by the flanges. The acutely extending lips can help to guide the panel (e.g. fin) elongate edge between the flange distal end edges during its insertion into the channel.

In an embodiment, the panel may be formed of a deformable material such that the member (e.g. channel) may be push-fit into the recess at the panel edge. For example, the panel may be formed of a thermally bonded polymeric (e.g. polyester) fibre material or natural (e.g. wool) fibre material.

In an embodiment, the panel may comprise a number of discrete recesses spaced out along the edge thereof. Each recess can locate a respective member (e.g. channel) therein.

In an embodiment, each panel recess may comprise opposing inwardly-facing faces. The inward faces of the panel outer recess portion may taper outwardly at the panel edge such that these inward faces are able to engage with (and e.g. guide) corresponding external faces of the member (e.g. channel) sidewalls to thereby guide the member when it is push-fit into a respective panel recess via the open outer recess portion.

In an embodiment, the system of the first aspect may further comprise at least one end cap (i.e. typically two end caps per member). Each end cap may be configured for secure location at a respective end of the member. The end caps can e.g. aesthetically finish off an installation and can cover any sharp edges of the member ends. The end caps may be moulded from a plastic material, which may also be light-transmissive or opaque.

In one form, when the member is hollow, each end cap may comprise a boss that protrudes from a plate. The boss can be formed to have an external profile that generally corresponds to (e.g. closely matches) an internal profile of the hollow member. This can enable the end cap to be push-fit into the respective end of the member.

In another form, when the member is hollow, each end cap may take the form of a connector. The connector can have bosses that protrude from respective, opposite sides of a plate. Again, each boss can be formed to have an external profile that generally corresponds to (e.g. closely matches) an internal profile of the hollow member. Thus, each boss may be push-fit into an end of a respective hollow member such that the connector can extend between and connect hollow members end-to-end.

In an embodiment, each boss may comprise a number of elongate panel-retaining inserts that project from a surface of the plate. A first pair of inserts can be arranged to locate between each flange and the base. A second pair of inserts can be arranged to locate between each flange and a respective sidewall distal end edge. In use, the first and second inserts can cooperate with the flanges, base and sidewalls to retain the end cap to the member end.

Also disclosed herein is an elongate member for use with the system of the first aspect as set forth above. The elongate member may be configured in the form of an elongate channel, such that a base of the channel is configured to be mounted with respect to the structure, and such that opposing spaced sidewalls of the channel extend from the base to define the channel. The channel locates and houses a light source therewithin. The channel retains an elongate cover formed of a light-transmissive material at an opening to the channel located between the channel sidewalls.

Also disclosed herein is a panel for use with the system of the first aspect as set forth above. The panel may be configured as set forth above (e.g. to comprise at least one corresponding recess therein).

Also disclosed herein is an elongate cover for use with the system of the first aspect as set forth above. The cover may be configured as set forth above.

Also disclosed herein is an end cap for use with the system of the first aspect as set forth above. The end cap may be configured as set forth above.

Also disclosed herein is a mounting fixture when that mounting fixture is used with the system of the first aspect as set forth above. The mounting fixture may be configured as set forth above.

Also disclosed herein is a kit for use with the system of the first aspect as set forth above. The kit can comprise one or more of the channel, panel, elongate cover, or end cap or as set forth above. The kit can optionally comprise one or more mounting fixtures as set forth above. The kit may alternatively be supplied without panel(s), which may be supplied separately to other components of the mounting system.

Also disclosed herein is a method for mounting a panel as set forth above with respect to a structure. For example, the method can be employed to install one or more such panels using one or more elongate members as set forth above. The method can be used to install such panel(s) at or in relation to a ceiling, ceiling space, false ceiling, wall, frame, divider, partition, border, fixture, furniture, etc. The panel to be installed can take the form of an acoustic panel, baffle or fin, but again is not so limited.

The method comprises mounting a base of the elongate member with respect to the structure. The method also comprises mounting to the member a panel by way of locating the member in the panel recess. Typically, each member is pre-installed with respect to the structure, and the panel then mounted thereto, although each panel may first be secured to the (or each) member, and then each member may be installed at or with respect to the structure.

In one form of the method, the panel may be mounted to the member by a relative sliding of the member laterally through the recess (e.g. one or both or the panel and member may be slid). In another form of the method, the panel may be mounted to the member by push-fitting the member into the recess via the open outer recess portion (e.g. one or both or the panel and member may be push-fit to the other). The panel may be configured (e.g. it may be deformable) such that it can be both slide or push-fit to the member.

In one embodiment of the method, the panel may comprise a number of discrete recesses spaced out along the edge thereof. A number of members that correspond to the number of discrete panel recesses may be mounted in a spaced manner with respect to the structure. The panel may be pre- or post-installed to the corresponding number of members.

In one embodiment of the method, a number of panels may be mounted to the member(s), e.g. in a spaced manner. Thus, a given installation may comprise a number of spaced members and a number of spaced panels.

In one form of the method, each member may be mounted directly to the structure (e.g. via one or more fasteners). The fasteners may be installed directly though each member, or the fasteners may comprise one or more mounting fixtures (such as set forth above) that may be pre-installed at the structure and then the member may be mounted thereto.

In another form of the method, each member may be mounted indirectly to the structure (e.g. via one or more mounting fixtures, such as set forth above). For example, each member may be suspended or spaced with respect to the structure.

In one embodiment, the method may further comprise retaining an elongate cover to the or each member. For example, when multiple panels are mounted to the member(s), a discrete elongate cover may be retained at the member to locate between adjacent panels. A discrete elongate cover may also be retained at the member to locate between an end-most panel and a respective adjacent member end. Each discrete elongate cover may be configured as set forth above.

In one embodiment, the method may further comprise securing at least one end cap (typically two end caps) to a respective end of each member. Again, the end cap may be configured as set forth above.

In one embodiment of the method, the end cap may be a connector as set forth above (i.e. the connector may be located between so as to connect adjacent members end-to-end).

Also disclosed herein, in a further aspect, is a system for mounting a panel such as an acoustic panel, baffle or fin. The system of the further aspect can, for example, be configured to support a so-called "cloud" panel, baffle or fin. The system can e.g. allow the panel to be suspended from a structure. The system can e.g. allow a number of panels to be suspended from a structure.

The system of the further aspect comprises a first elongate member. A base of the first member is configured to enable it to be mounted with respect to a structure (e.g. at or suspended from a ceiling, ceiling space, false ceiling, roof, etc.). Opposing sidewalls of the first elongate member can extend from the base such that, in profile (i.e. when viewed from the member end), the sidewalls can define a neck portion. The sidewalls can project laterally out from the neck portion to define an outwardly projecting step-formation. Each sidewall can extend from its respective step-formation to an enlarged head portion of the first elongate member. Thus, in the system of the further aspect, the first (or each) elongate member can be as defined above for the first aspect.

The system of the further aspect also comprises a first panel. Typically, the first panel takes the forn of an acoustic panel, baffle or fin. The first panel can be arranged to be located adjacent to the first elongate member. In this regard, an edge of the first panel can locate adjacent to the neck portion of the first elongate member, and a face of the first panel can locate adjacent to the head portion of the first elongate member. Thus, when the first member is mounted with respect to a structure (e.g. a ceiling, ceiling space, false ceiling, roof, etc.), the first member can support thereat a respective edge of the first panel (i.e. the first panel can likewise be mounted with respect to the structure).

For example, where the system of the further aspect only makes use of one elongate member, an opposite edge of the first panel may be supported by an opposing structure (e.g. a wall, post, etc.). Thus, one edge of the first panel can be supported by the first elongate member, and e.g. the opposing edge of the first panel may be supported at the wall, post, etc.

In an embodiment, the system of the further aspect may further comprise a second panel. Typically, the second panel also takes the form of an acoustic panel, baffle or fin. The second panel may be arranged to be located adjacent to an opposite side of the first elongate member to where the first panel is to be located. In this regard, an edge of the second panel can locate adjacent to the neck portion of the member, and a face of the second panel can locate adjacent to the head portion of the member. Thus, the one elongate member can support respective edges of first and second panels at either side thereof.

In an embodiment, the system of the further aspect may further comprise a second elongate member. The second elongate member may be located adjacent to the first elongate member, although typically it is spaced or extends therefrom in use. For example, in one variation, the second elongate member may be spaced parallel to the first elongate member, whereby a first panel can extend between and be supported at its opposing edges by the first and second elongate members. In another variation, the second elongate member may extend at an angle to the first elongate member, whereby a first panel can extend between and be supported at adjacent edges thereof by the first and second elongate members.

In an embodiment, the second elongate member may be arranged so as to support another (e.g. opposite or adjacent) edge of the first panel at the neck portion of the second elongate member, with the face of the first panel locating adjacent to the head portion of the second elongate member. Thus, the first panel can span between and be supported by the first and second elongate members in use.

For example, when the first panel is rectangular or square in shape, and where the first and second elongate members are spaced and parallel, the first panel can be supported at opposing edges, respectively, by the first and second elongate members. In another example, when the first panel is rectangular or square in shape, and where the second elongate member extends orthogonally from the first elongate member, the first panel can be supported at adjacent (i.e. corner) edges by the first and second elongate members.

In a further variation, the second elongate member can also be arranged to extend at a "non-orthogonal" angle to the first elongate member. This arrangement can define an "acute corner" and an "obtuse corner" between the first and second elongate members. A first (e.g. triangular-corner-type) panel may be configured to locate and be supported in the acute corner, and a second (e.g. a trapezoidal-corner-type) panel may be configured to locate and be supported in the obtuse corner.

In an embodiment, the second elongate member may be arranged to extend from an end of the first elongate member. Further, the second elongate member may extend from the first elongate member end at an orthogonal or non-orthogonal angle. Additionally, the second elongate member may extend from the first elongate member end from either an end of the second elongate member, or from an intermediate location of the second elongate member. In each such case, the first panel may span between the first and second elongate members whereby respective edges of the first panel are supported at the first and second elongate members. Further, a second panel may be arranged at an opposite side to the first panel.

In an embodiment, the system of the further aspect may further comprise third and, optionally, fourth elongate members. For example, the second elongate member may be arranged to oppose and be spaced apart from the first elongate member, and the fourth elongate member may be arranged to oppose and be spaced apart from the third elongate member. When the system comprises first to fourth elongate members, these may be arranged and employed to support a first panel having four sides (e.g. square, rectangle, rhombus, trapezium, etc.). In this regard, the first panel may be configured to locate between and be supported at respective edges thereof by the first, second, third and fourth elongate members.

For example, the third and fourth elongate members may extend between and join the first and second elongate members (e.g. form a closed body of elongate members). In this arrangement, the respective ends of the third elongate member may be located at respective ends of the first and second elongate members, and the respective ends of the fourth elongate member may be located at respective opposite ends of the first and second elongate members.

In an embodiment, the system of the further aspect may comprise more than four elongate members, which can be assembled and arranged in the various configurations as outlined above. For example, the resulting configuration may comprise a five or more-sided regular polygon (e.g. a closed body with equal length sides). Alternatively, the system may be configured in the form of an irregular polygon, i.e. sides of unequal length. The first and further panels to be supported thereat can be configured accordingly.

In an embodiment, the second panel may be configured to surround and be supported at respective inner edge(s) thereof by the first, second, third and, when present, fourth or more elongate members. For example, an inner aperture of the second panel may be configured with the same external shape as the configuration of the first, second, third, or more elongate members.

The system of the further aspect further comprises one or more clamping elements. Each clamping element can be arranged to clamp at least one panel to a respective elongate member. For example, each clamping element can be arranged to be connected to an elongate member at the base of the elongate member.

Each clamping element may be adjustable and can be arranged to apply a clamping force to a respective panel located at the elongate member. In this regard, each clamping element may be connected to a respective elongate member via a rod. Each clamping element may be rotated around the rod between a non-clamping and clamping position.

In a variation, the rod may be threaded, whereby the rod can be screw-adjusted to increase or to release the clamping force.

When in the clamping position, the force that is applied by each clamping element can act at a face of the panel that is opposite to the panel face that is located at the head portion of the elongate member. In an embodiment, each clamping element may be arranged at an elongate member to apply a clamping force to respective panels located at either side of the elongate member.

BRIEF DESCRIPTION OF THE DRAWINGS

Embodiments will now be described, by way of example only, with reference to the accompanying drawings in which:

FIGS. 19A-19F are schematic end views illustrating, in sequence, the assembly of the panel mounting system according to this disclosure;

DETAILED DESCRIPTION OF SPECIFIC EMBODIMENTS

Figure 1B:
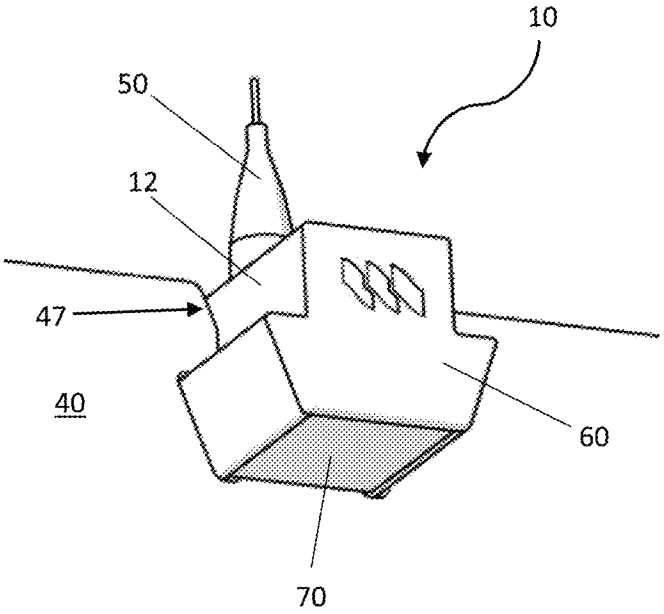
FIGS. 1A & 1B are exploded and assembled perspective views of part of a panel mounting system according to this disclosure, when used in a suspended format.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

Figure 1A:
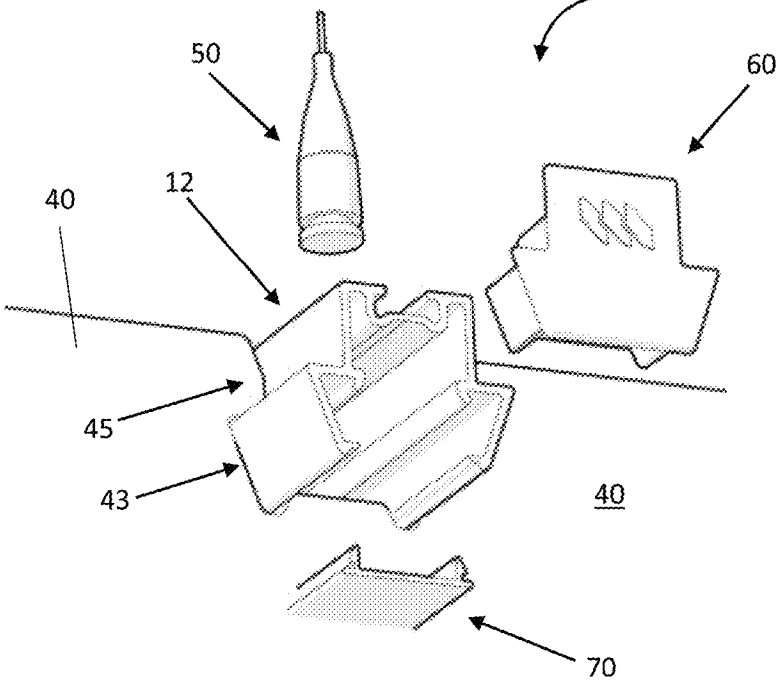

FIGS. 1A & 1B illustrate a system for mounting a panel with respect to a structure. The panel can take the form of an acoustic panel, baffle, fin, blade or fabric but is not so limited. The structure can be a ceiling, ceiling space, false ceiling, wall, frame, divider, partition, border, fixture, furniture, etc., but again is not so limited.

Figure 14:
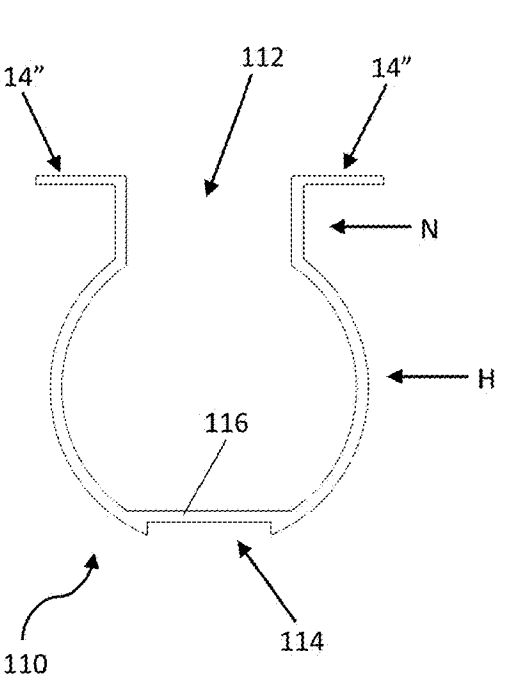
FIG. 14 is an end (profile) view of a member in the form of an elongate channel according to yet another embodiment.
Figure 13:
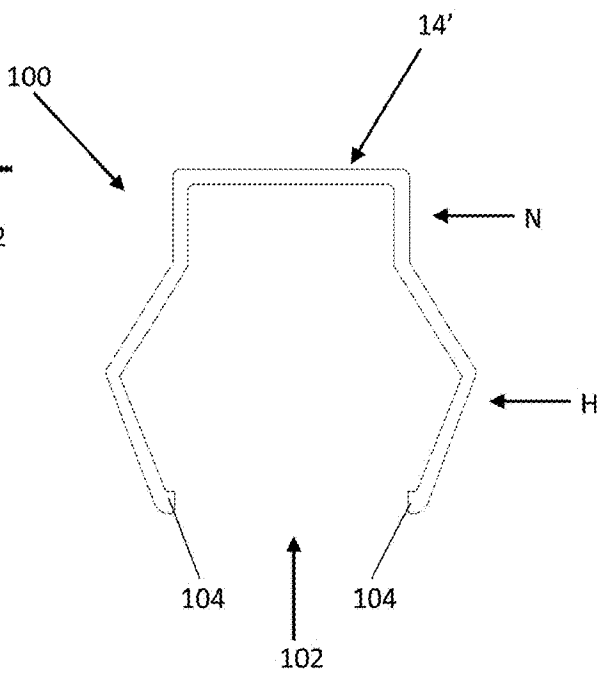
FIG. 13 is an end (profile) view of a member in the form of an elongate channel according to another embodiment.
Figure 12:
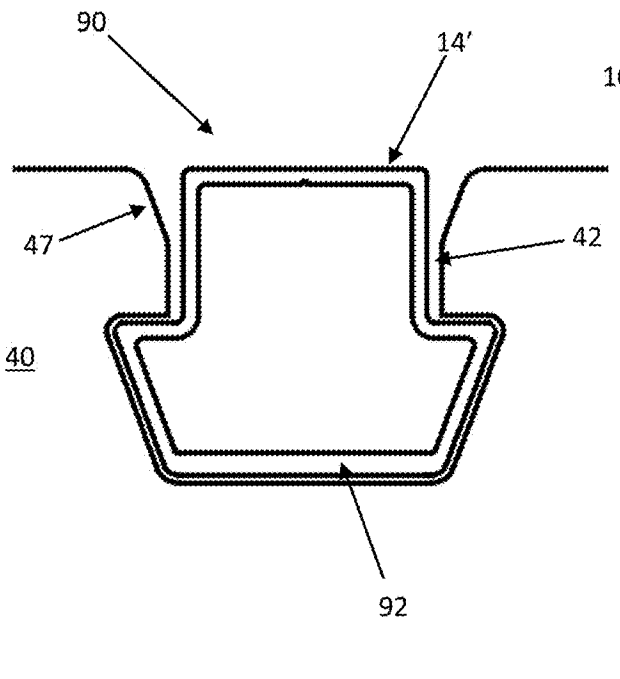
FIG. 12 is an end (profile) view of a member in the form of an elongate hollow section when retained in a corresponding panel recess as part of the system as disclosed herein.

The particular form of the system 10 as illustrated comprises a number of components, including an elongate member in the form of a channel 12. Other channel profiles are illustrated in FIGS. 12-14 and will be described later.

Other components of the system, as illustrated in FIGS. 1A & 1B, include a panel 40, a securing mechanism in the form of a mounting fixture 50, a terminating end cap 60 and a cover 70.

The channel 12 will initially be described. The channel 12 has a particular type of profile (see especially FIG. 9). In this regard, opposing sidewalls 13 of the channel 12 extend from a channel base 14 such that, when the channel 12 is viewed in profile (i.e. from the end of the channel 12), the sidewalls are configured to define a neck portion N that extends to an enlarged head portion H of the channel 12. This neck N and head H are also present in the channel profiles illustrated in each of FIGS. 12-14.

Channel 12 is typically in the form of an extrusion, such that it may be extruded from metal, composite or plastic. However, in a variation to a channel, the elongate member can have a solid form (e.g. to have a rod-like or bar-like form) but can still be formed to have a neck portion and an enlarged head portion. In this case, the elongate member is not able to support therewithin a light source (such as described below). Further, to enable it to be secured with respect to a structure, the solid rod- or bar-like form may have pilot holes or other formations for fasteners (including for adhesives, or a mounting fixture, etc.).

The channel may have other forms (see e.g. FIGS. 13 & 14 as later described). Alternatively, the channel can be replaced with a closed hollow section (see e.g. FIG. 12 as later described). In each case the elongate member can still be formed to have a neck portion and an enlarged head portion.

Each of the opposing channel sidewalls 13 is configured to define an outwardly projecting step-formation in the form of step 15 (i.e. at the juncture of the neck N with the head H). In the channel 12, walls 17 of neck N extend generally orthogonally from the base 14 to the step 15. The step 15 then projects laterally out from each wall 17. The head H comprises walls 19 that each extend from a respective step 15 at an acute angle to a distal end edge 21 of the wall 19. The distal end edges 21 are spaced to define an open end 25 of the channel 12. Alternatively, the walls of the head H can extend such that they are connected (e.g. as a continuous wall), instead of being spaced at their distal end edges (see e.g. the channel embodiments of FIGS. 12 & 14).

The base 14 of the channel 12 is configured to enable it to be mounted with respect to the structure. For example, in the embodiment shown in FIGS. 1 & 9, an external side of the base 14 (i.e. the side that typically faces the structure) comprises an inwardly formed elongate recess 16. This recess 16 typically extends for the length of the channel and opens out from the base 14. As explained below, the recess 16 can allow for a suitable fastening mechanism to be connected to the base 14. In other variations of the base wall (see e.g. FIGS. 12 & 13), the base 14' can comprise a planar wall. Further, the base wall 14" need not be continuous across the width (side-to-side) of the base (see e.g. FIG. 14).

Drill holes or pilot holes can optionally be spaced out along the planar wall of base 14,14',14" to allow for e.g. structure-securing screws, bolts, etc. to be driven up through the base wall 14,14',14" so as to mount the channel 12 with respect to (e.g. directly to) the structure.

Figure 9:
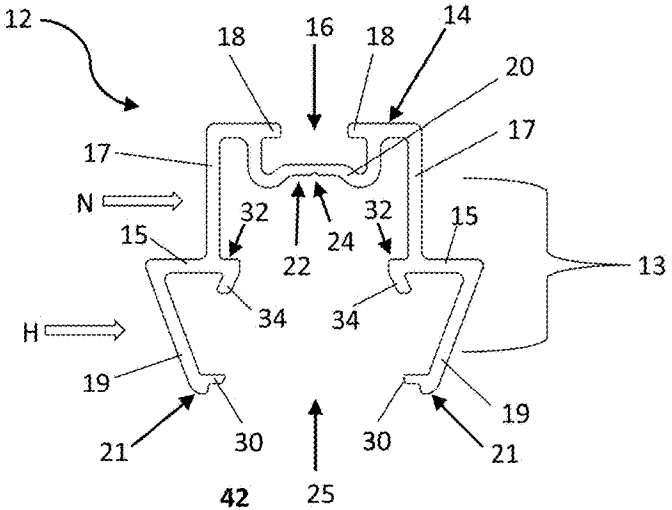
FIG. 9 is an end (profile) view of a preferred member in the form of an elongate channel.

Referring particularly to FIG. 9, the opening to the base recess 16 is further defined by opposing and inwardly projecting lips 18 that extend for a length of the recess (typically for the entire length, but which may extend for discrete length sections of the recess 16). The lips 18 function to provide a structure for a suitable fastening mechanism to be secured to the channel 12.

In the system embodiment of FIG. 1, the suitable fastening mechanism takes the form of an elongate mounting fixture 50. The mounting fixture 50 is also shown in more detail in FIG. 16. The mounting fixture 50 is configured such that it can either be mounted directly to (e.g. by being affixed within) the structure, or it can be suspended/spaced from the structure. In this regard, an in-use upper neck 52 of the mounting fixture 50 is adapted to secure a suspension line 54 (e.g. wire, cable, etc.) thereto, such that the mounting fixture 50 can e.g. hang freely from a structure (e.g. ceiling, roof, etc.).

Figure 16:
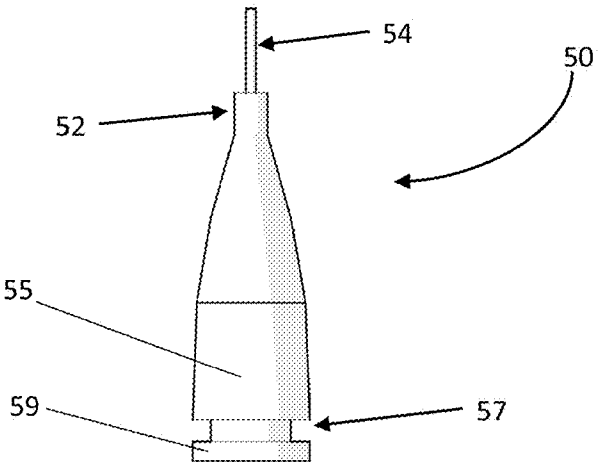
FIG. 16 is a side view of a mounting fixture for use with the preferred elongate channel of FIG. 9, being the fixture as also shown in FIGS. 1A & 1B, 2, 3 & 11.

As shown in FIG. 16, an opposite in-use lower enlarged body 55 of the mounting fixture 50 is configured to locate within the base recess 16 to be retained therein by the lips 18. In this regard, the body 55 is provided with a groove 57 therein. Typically, the groove 57 extends peripherally around the body 55. The groove 57 also defines a head 59 at the in-use lower end of the body 55.

Figure 11:
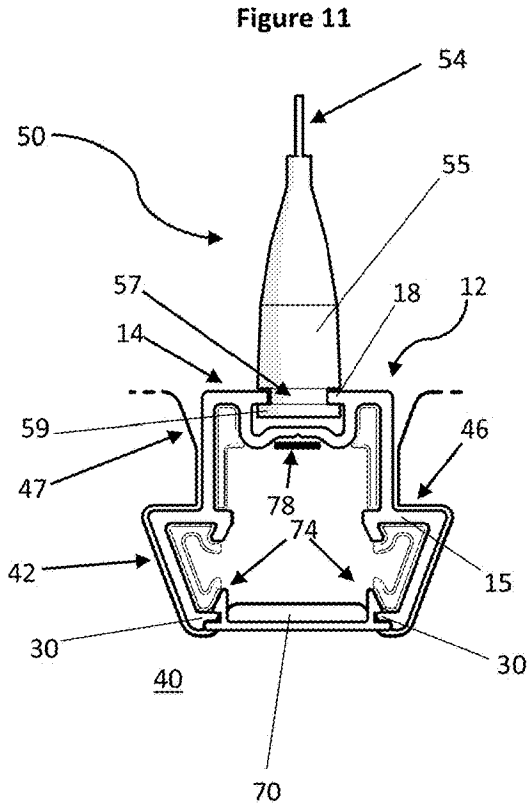
FIG. 11 is an end (profile) view of the preferred elongate channel of FIG. 9 when assembled and retained in the corresponding panel recess as part of the system as disclosed herein.

The groove 57 enables the lower end of the body 55 to be slid into the recess 16 from one end of the channel 12. In this regard, and as best shown in FIG. 11, during such sliding in, the lips 18 are received so as to locate in the groove 55, with the head 59 being captured under and retained by the lips 18. Typically, the lips 18 are received in the groove 55 in a snug but slidable fit. When the lower end of the body 55 has located at a suitable position along and in the recess 16, a remainder of the body 55 protrudes outside of the recess 16 so that the mounting fixture 50 projects away from the base in use (e.g. upwardly).

Referring again to FIG. 9, it will be seen that an-use lower wall 20 of the recess 16 is countersunk at 22 (i.e. at an opposite side of the wall to the recess 16). The countersunk side typically extends for a length of the wall 20 (e.g. for the entire length or for discrete length(s) of the wall). An LED strip light can be located (e.g. affixed, riveted, screwed, etc.) within the countersink 22. The countersink 22 can also be configured (e.g. by spaced-out pilot indentations 24) to have one or more fasteners (e.g. screws, etc.) secured there-through for direct mounting of the base 14 to the structure). Each indentation 24 can also be countersunk to enable a flush-mounting of a head of the fastener at the wall 20. In this way, the LED strip light can still be flush-located within the countersink 22 to cover each such fastener head.

The distal end edge 21 of each head wall 19 comprises an inwardly projecting lip 30 that runs for a length of the wall 19 (e.g. for the entire length or for discrete length(s) of the wall 19). The lips 30 are arranged to oppose and project towards each other. As best shown in FIG. 11, the lips 30 are configured to retain the cover 70 to close over the open end 25 of channel 12. In this regard, ledges 76 of flanges 74 (described below) of the cover 70 can be retained at the lips 30 such as by a snap- or slide-fit.

Figure 5:
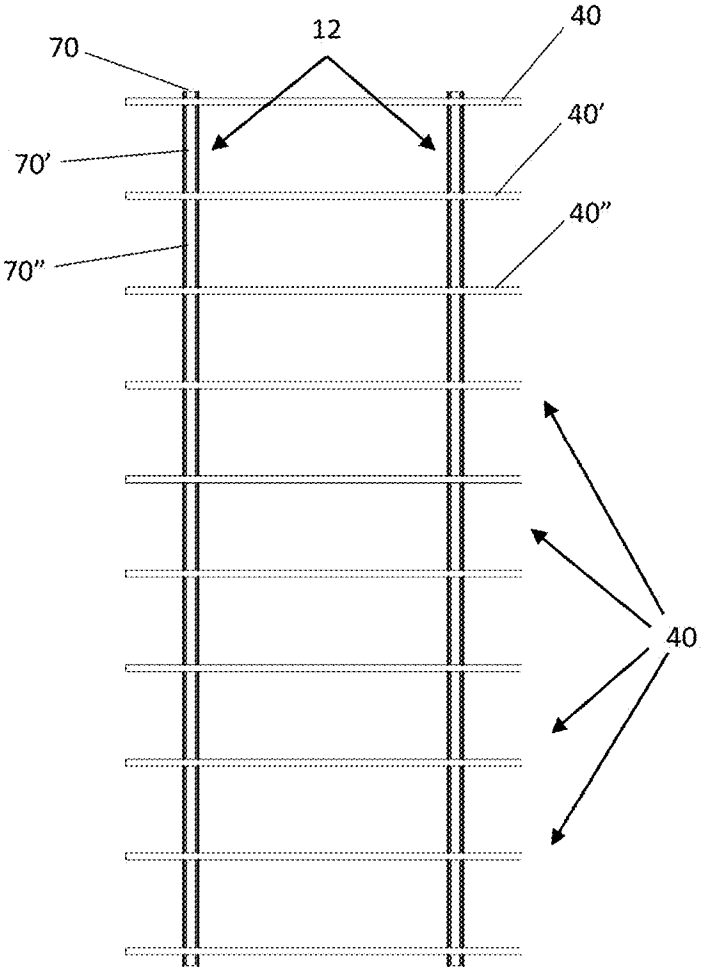
FIG. 5 is an underside plan view of the panel mounting system when used in a suspended or direct-mounted format such as at a ceiling or similar, the system comprising multiple panels and two members.
Figure 7:
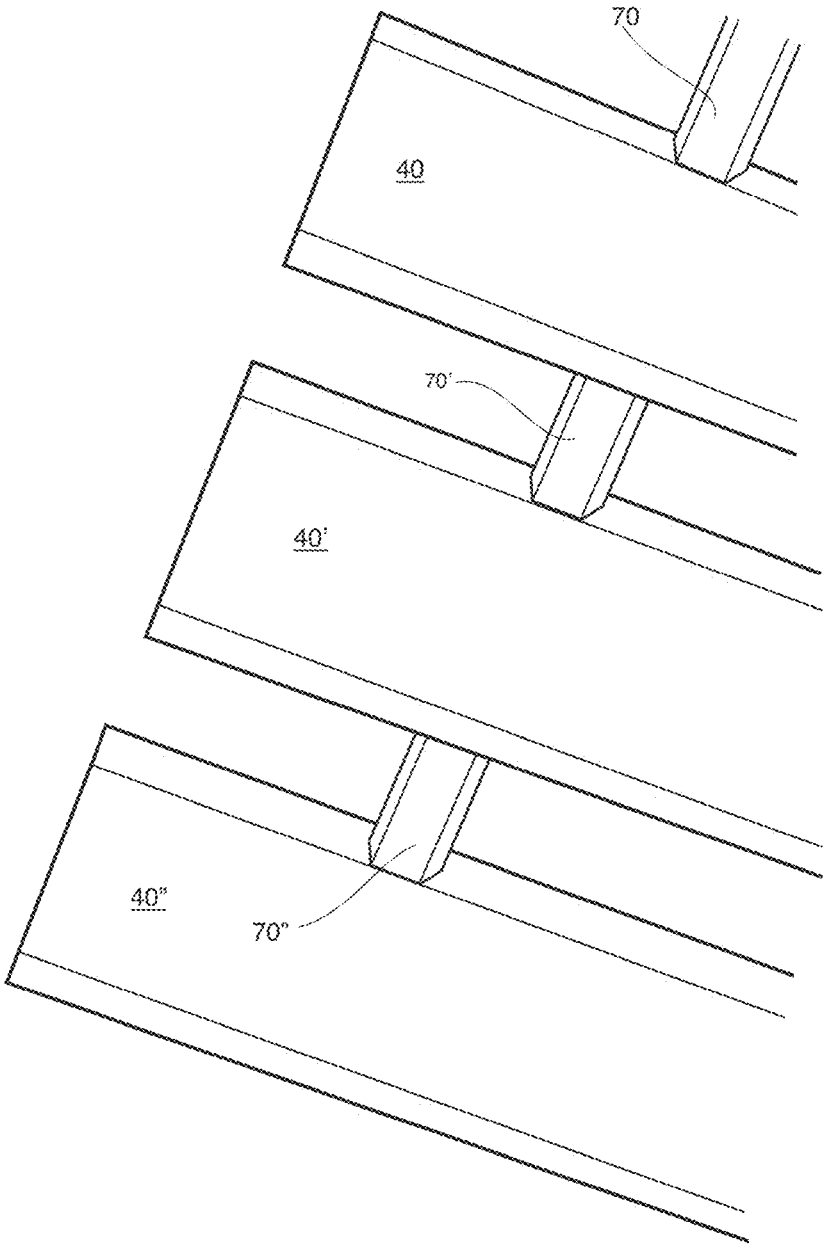
FIG. 7 is an underside perspective view of the panel mounting system when used in a suspended or direct-mounted format at a ceiling or similar, the view illustrating a lighting configuration.
Figure 15:
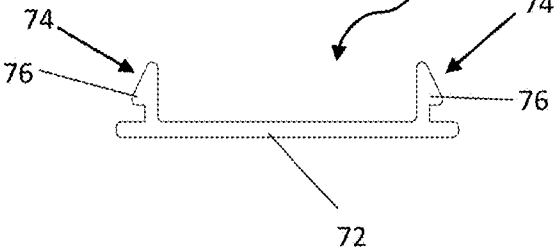
FIG. 15 is an end (profile) view of a cover for use with the preferred elongate channel of FIG. 9, being the cover as also shown in FIGS. 1A & 1B.

As best shown in FIGS. 1A and 15, the cover 70 is in the form of an elongate strip 72. The strip 72 is provided with a pair of elongate, upstanding and spaced parallel flanges 74 that each project from and extend along a face of the strip 72. Each flange 74 defines a ledge 76 that is configured interact with (e.g. by a snap- or slide-fitting) a respective lip 30 defined at a corresponding distal end edge 21 of each head wall 19. In this way, the cover 70 can be readily retained at and thereby cover the open end 25 of the channel 12.

Where multiple panels 40 are to be secured to the channel (s) 12, a number of discrete length covers 70, 70', 70", etc. can be employed to between e.g. respective panels 40, 40', 40" (see e.g. FIGS. 5, 7 & 8).

For example, as best shown in FIG. 5, the discrete length covers can have preformed lengths, which then enables a regular spacing of the multiple panels 40 to be achieved. For example, a first end cover 70 can be secured to the channels 12, and then a first panel 40 can be mounted thereto. Then a second cover 70' can be secured to the channels 12, and then a second panel 40' can be mounted thereto. Then a third cover 70" can be secured to the channels 12, and then a third panel 40" can be mounted thereto, and so on for the length of the channels 12.

Each cover 70 can be formed of the same material as the channel (e.g. a metal such as aluminium, plastic, etc.). The cover 70 can be formed from an opaque material. Alternatively, the cover 70 can be formed of a different material to the channel (e.g. from a light-transmissive and/or polymeric material such as PVC, polycarbonate, etc). When formed of a light-transmissive material (e.g. a translucent or transparent material such as a polymer), the channel can hold a source of light (e.g. an LED strip light 78—FIG. 11) and thereby release light in use (e.g. the released light can pass through the cover and fall onto and/or reflect from panel(s) mounted to the channel, etc.). This lighting effect is schematically illustrated in FIG. 7.

Referring again to FIG. 9, each sidewall 13 of the channel 12 further comprises a flange 32 that projects inwardly from an intermediate location of a respective sidewall. Each such flange 32 can be elongate to extend for a length of a main recess of the channel 12 (e.g. for the entire length or for discrete length sections of the main channel recess). The flanges 32 are opposed to generally project towards each other. For example, each flange 32 as shown is formed as a continuation of the step 15. Each flange 32 comprises a lip 34 that extends at an acute angle from a distal end edge of the flange, the lip projecting generally away from the base 14. The spacing of the distal end edges of the flanges 32 is such that an elongate edge of panel, such as an acoustic fin or blade F, can be positioned between and be retained by the flanges 32.

In this regard, two related fin-retaining assemblies 75 are respectively shown in FIGS. 8A & 8B, and FIGS. 8C & 8D. In each assembly, the acutely extending lips 34 of the channel 12 help to guide an elongate edge of the panel (e.g. fin or blade F) between the flange distal end edges during insertion of the fin F into the channel 12 (i.e. via the channel open end 25).

Figure 8A:
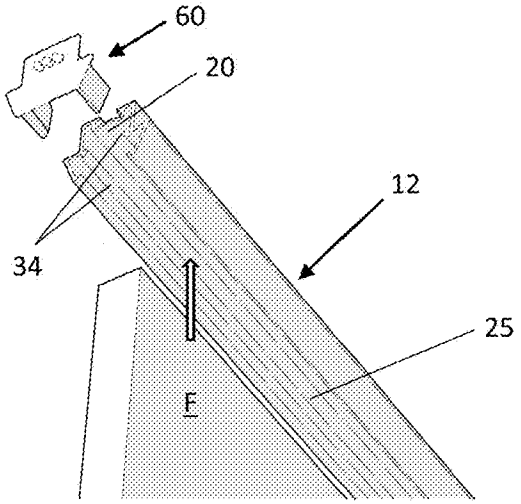
FIGS. 8A & 8B and FIGS. 8C & 8D respectively show assembled and exploded detail perspective views of two fin-retaining assemblies that form a part of the mounting system as disclosed herein.
Figure 8B:
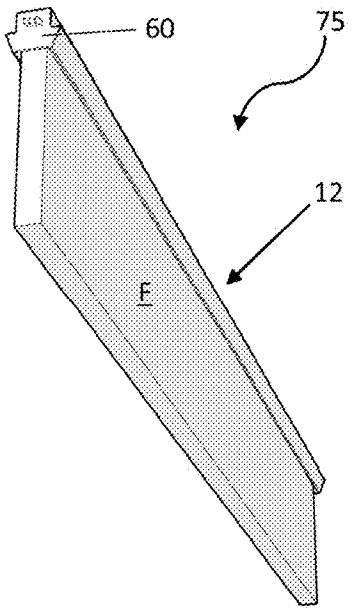
Figure 8C:
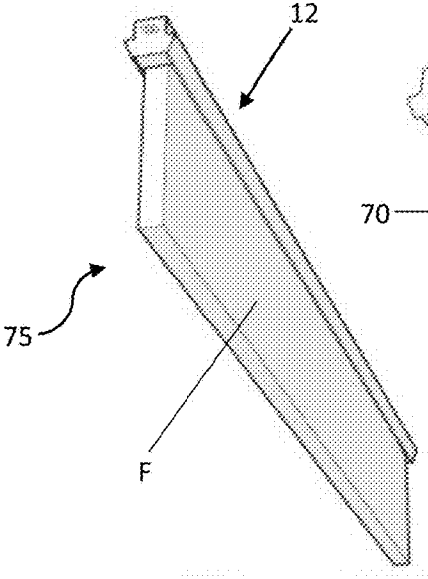
Figure 8D:
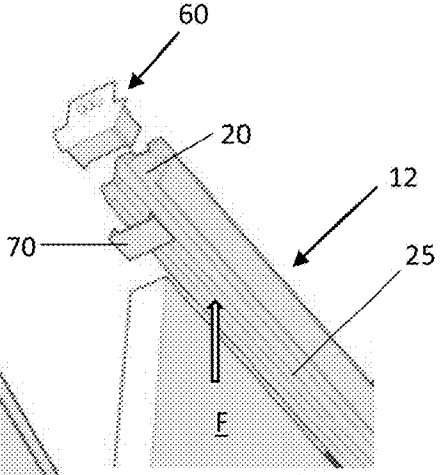

As shown in each of FIGS. 8A and 8D, a fin or blade F can be push-fit up through the channel open end 25, with opposing side walls of the fin F being gripped and slightly deformed by the opposing lips 34 of the flanges 32, typically until the upper edge of the fin contacts the underside of recess wall 20. Such a push- or press-fit can have sufficient interference/friction that no separate adhesive or other fastener is required.

FIGS. 8C & 8D also show a modified (i.e. short) section of cover 70 to be located (e.g. snap- or slide-fit) to the channel 12, on the outside end edge of each fin. Whereas no such short section of cover 70 is employed with the assembly of FIGS. 8A & 8B (i.e. the length of fin F is matched to sit within the end caps 60 located at opposing ends of channel 12). In either case, having located fin F in place, respective end caps 60 can be push- or press-fit into the respective ends of the channel 12. Each assembly 75 can be configured such that the end caps 60, and short covers 70 (when used), can contribute to the retention of fin F in channel 12.

The system also comprises a panel 40. As above, typically the panel takes the form of an acoustic panel, baffle or fin. Each panel 40 can be formed of a deformable material such that the channel 12 (e.g. channel) may be push/press-fit into a recess 42 located at a panel edge (e.g. long edge). For example, the panel can be formed of a thermally bonded polymeric (e.g. polyester) fibre material or natural (e.g. wool) fibre material.

Figure 2:
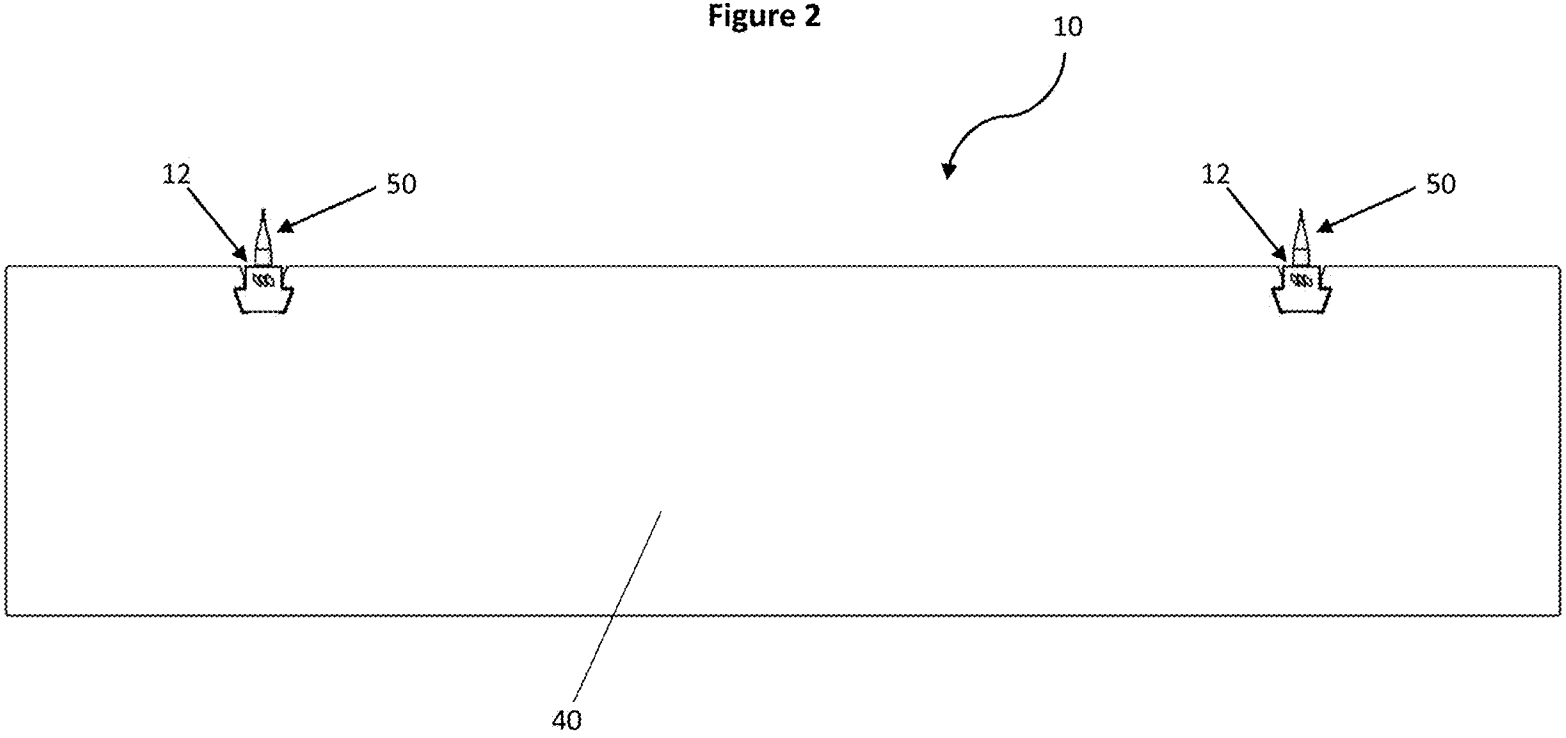
FIG. 2 is a front perspective view of the panel mounting system when used in a suspended format with one panel and two members.
Figure 4:
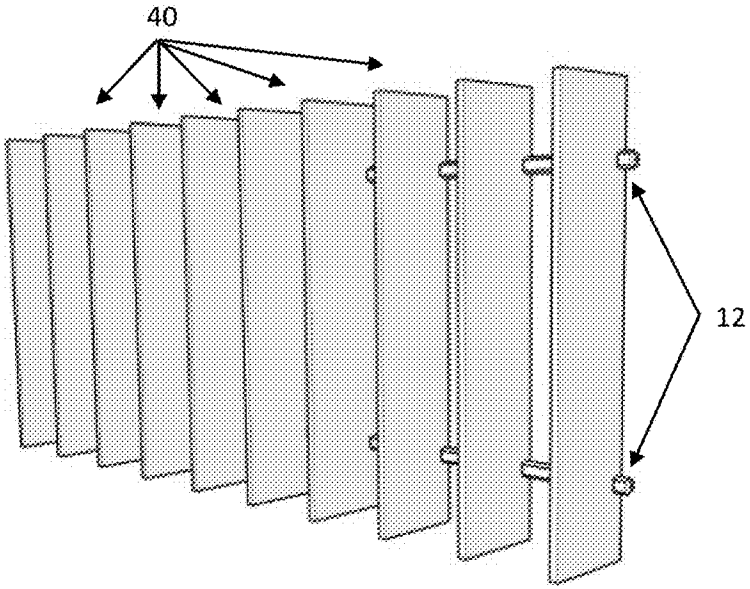
FIG. 4 is a front perspective view of the panel mounting system when used in a wall, barrier or divider format with multiple panels and two members.
Figure 3:
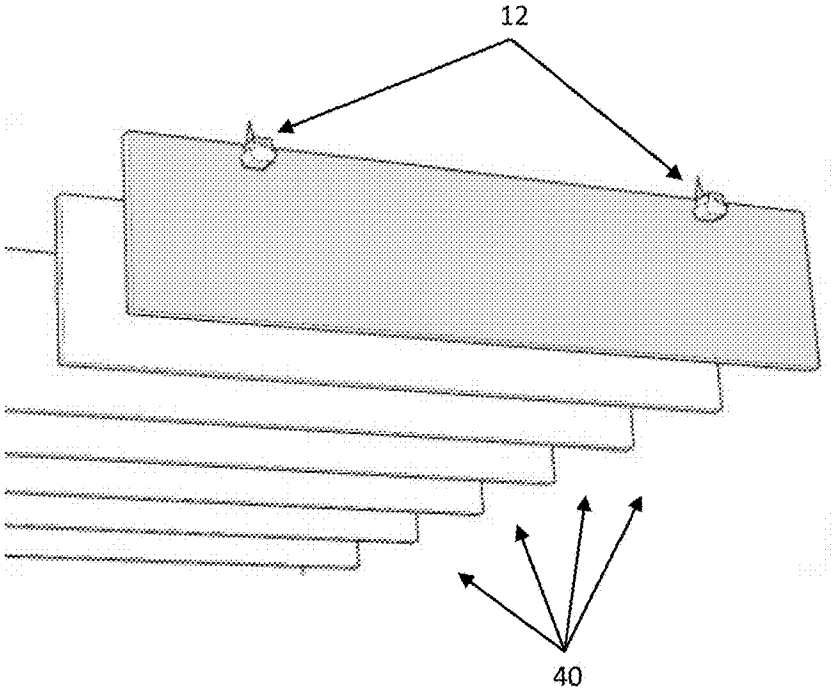
FIG. 3 is a front perspective view of the panel mounting system when used in the suspended format with multiple panels and two members.
Figure 6:
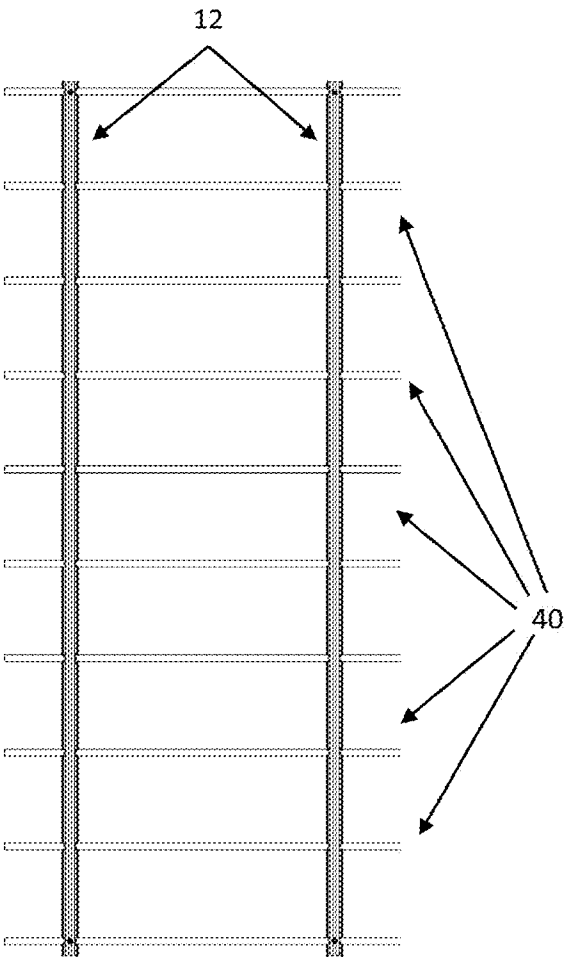
FIG. 6 is a plan view of the panel mounting system of FIG. 5.
Figure 10:
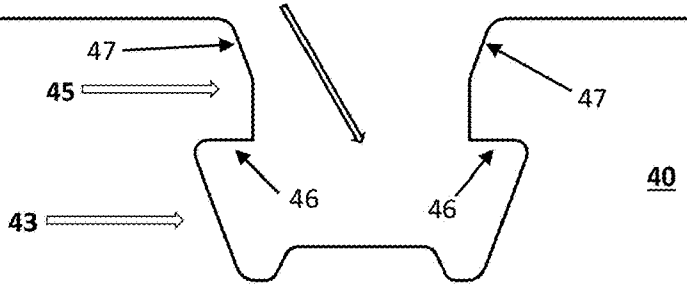
FIG. 10 is a side (detail) view of a preferred panel recess that is correspondingly shaped for the elongate channel of FIG. 9.

As best shown in FIGS. 1A and 10, the panel typically has at least one recess 42 formed in the edge thereof. The recess 42 is typically located in an in-use upper edge when the panel is to be suspended (see e.g. FIGS. 2 & 3), or at in an in-use side edge when the panel is to be used as a divider, barrier, etc. (see e.g. FIG. 4). For most applications usually two discrete and spaced recesses 42 along the panel edge is sufficient (see e.g. FIGS. 2-4). Further, multiple panels 40 can be supported by two spaced channels 12 (see e.g. FIGS. 3-6).

As best shown in FIG. 10, each recess 42 is configured to generally correspond to an external profile of the channel 12. Thus, the recess can be provided with an inner recess portion 43 that is enlarged to receive (e.g. snugly or closely) the channel head H. The recess is also provided with an outer recess portion 45 that is configured to receive (e.g. snugly or closely) the channel neck N. The outer recess portion 45 opens out of the panel edge. This enables the channel 12 to be mounted with respect to the structure. In this regard, as best shown in FIG. 11, the base 14 of the channel 12 generally sits flush with the adjacent panel edge, whereby the base is exposed to enable a suitable fastener (e.g. fixture 50 or a screw, adhesive, etc.) to interact therewith (e.g. to mount to or locate at the base 14, to extend through the base 14).

In use, when the channel 12 has been located in the panel recess 42, the panel 40 effectively becomes retained to the channel 12. For example, the channel 12 can be slid laterally through the recess. Additionally or alternatively, the channel 12 can be push- or press-fit into the recess 42, via the open outer recess portion. In this latter case of push/press-fitting of the channel into the recess 42, usually the panel deforms, however, the channel 12 may also be formed of e.g. a deformable material (e.g. polymer) that, to at least some extent, also deforms.

In FIG. 10, it will be seen that the sides of the panel recess 42 are configured to define corresponding inwardly projecting steps 46 (i.e. the correspond to the steps 15 of channel 12). The corresponding step-formations are defined at the juncture of the inner recess portion 43 with the outer recess portion 45. Thus, as shown in e.g. FIG. 11, when the channel 12 has been located in the recess 42, the corresponding channel and panel steps face each other (typically they abut) to thereby retain the panel 40 to the channel 12.

The upper sides of the outer recess portion 45 are also configured at 47 to taper outwardly (i.e. to open up the entranceway to the outer recess portion 45). The angle of the taper 47 is selected to generally match the angling of the head walls 19. In this way, the passage (e.g. push- or press-fit) of the head H of channel 12 into the recess 42 is facilitated, with the tapered sides 47 guiding the head H into the recess 42.

As set forth above, the system 10 further comprises at least one end cap to close off a respective end of a hollow channel 12. The end cap can take two forms. As shown in FIGS. 1-4, 8, 17 & 19, the end cap can take the form of a terminating end cap 60 (i.e. to close off a given end of a channel 12). Where both ends of the channel 12 are exposed, the system can employ two terminating end caps 60 per channel 12.

Figure 18B:
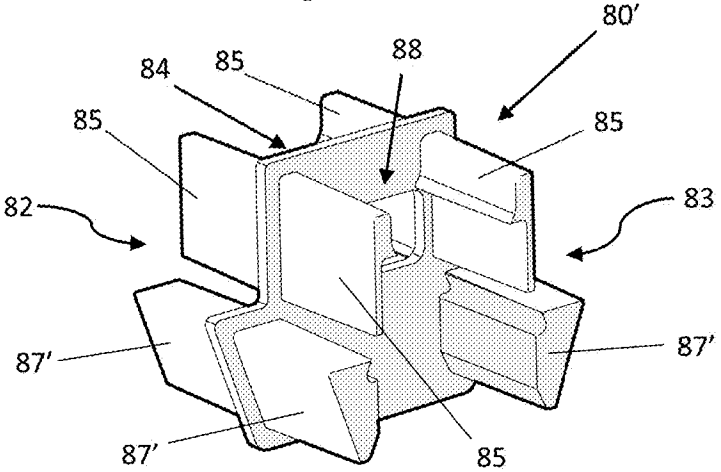
FIGS. 18A & 18B are perspective views of two variations of a connector for use with the preferred elongate channel of FIG. 9.
Figure 18A:
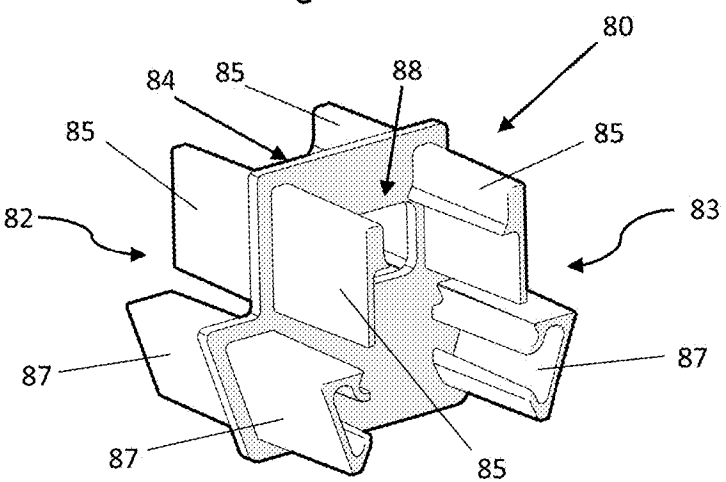

However, as shown in FIGS. 18A and 18B, the end cap can take the form of a connector end cap 80 (in FIG. 18A) and 80' (in FIG. 18B). When the end cap is in this form, the connector end cap 80,80' can still function to close off a respective end of a given channel 12, but it can enable a further channel 12 to be joined end-to-end with the given channel.

Usually the terminating end cap 60 and connector end cap 80,80' are each formed (e.g. moulded from plastic) as a unitary item. The end caps 60 and 80,80' can optionally be formed of a light-transmissive or opaque material. The end caps 60 and 80 can e.g. aesthetically finish off a system installation 10 and can cover any sharp edges of a respective channel end.

Figure 17:
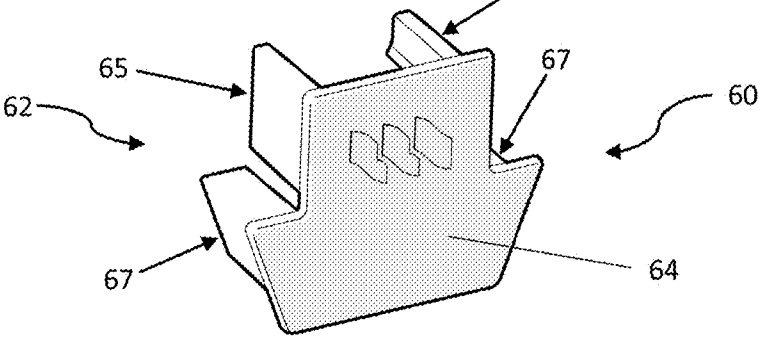
FIG. 17 is a perspective view of an end cap for use with the preferred elongate channel of FIG. 9, being the end cap as also shown in FIGS. 1A & 1B, 2, 3, 8A & 8B.

As best shown in FIGS. 17 & 19B, the terminating end cap 60 comprises a boss formation 62 that protrudes from a plate 64. The boss formation 62 is formed to have an external profile that generally corresponds to (e.g. closely matches) an internal profile of a hollow end of the channel 12. This enables the end cap to be push/press-fit into the respective end of the channel 12 (i.e. to be interferingly/frictionally retained at that end).

The boss formation 62 could comprise a single projection, however for ease of use (e.g. to account for manufacturing tolerances) it typically comprises a series of boss inserts in the form of a first pair of opposing neck bosses 65 and a second pair of opposing head bosses 67. Each boss pair projects from the same side of plate 64.

FIG. 19B illustrates a terminating end cap 60 having been secured to an opposite end of the channel 12. As shown, the neck bosses 65 are sized and spaced so as to respectively and closely interface with inside faces of the base 14 and walls 17 of the channel neck portion N. Likewise, the head bosses 67 are sized and spaced so as to respectively and closely interface with inside faces of the step 15 and walls 19 of the channel head portion H.

Figure 20:
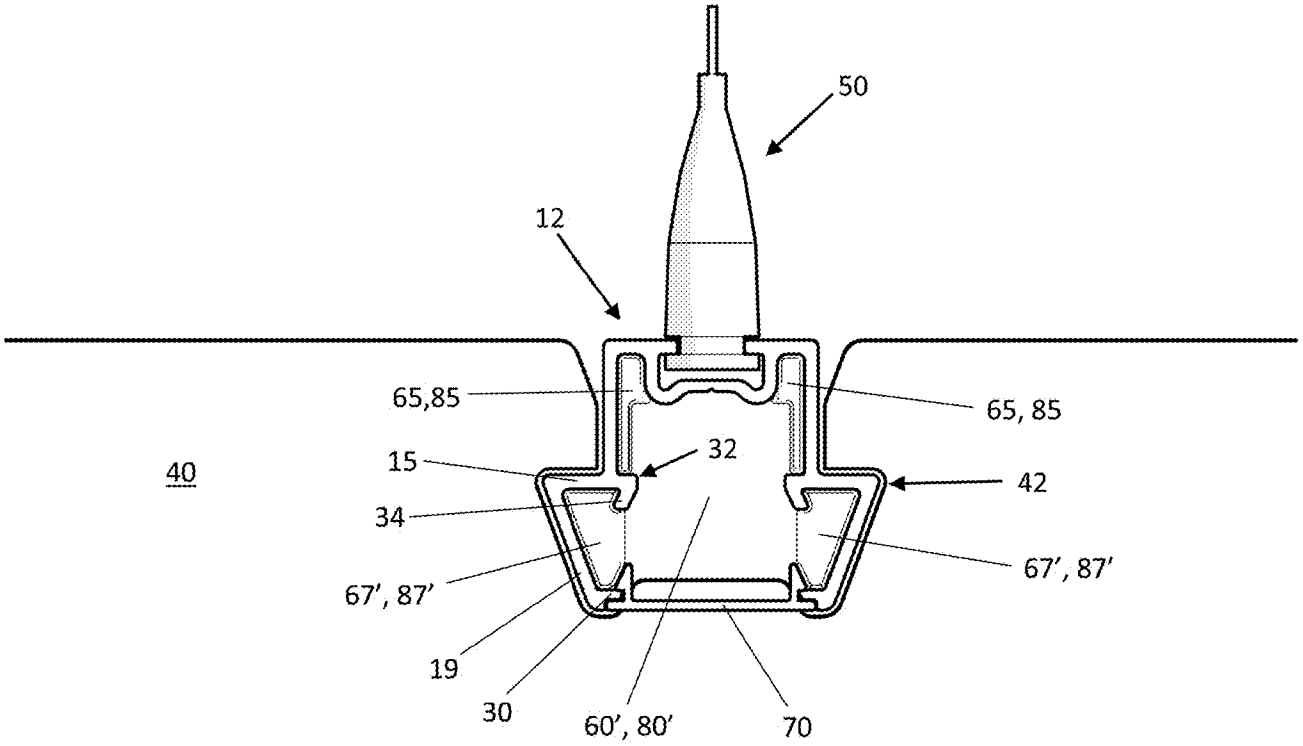
FIG. 20 shows a schematic end view similar to FIG. 19E, but where an end cap or connector variation (e.g. of FIG. 18B) has been secured into one end of the channel.

FIG. 20 shows a variation of the head bosses 67', being a variation that is the same as the variation of the head boss 87' as described below with reference to the modified connector end cap 80'.

As best shown in FIGS. 18A & B, the connector end cap 80,80' comprises a pair of opposing boss formations 82 & 83 that protrude form opposite respective sides of a plate 84. Each boss formation 82,83 is formed to have an external profile that generally corresponds to (e.g. closely matches) an internal profile of a hollow end of a respective channel 12. This enables the connector end cap 80,80' to be push/press-fit into the respective ends of the channels 12 (i.e. to be interferingly/frictionally retained between those ends and to thereby join the channel ends together). Thus, the connector end cap 80,80' can be used to lengthen the channels for a given system installation.

Again, each boss formation 82,83 could comprise a single projection, however, again for ease of use (e.g. to account for manufacturing tolerances) each boss formation 82,83 typically comprises a series of boss inserts. Thus, each boss formation 82,83 comprises a first pair of opposing neck bosses 85 and a second pair of opposing head bosses 87. However, it will be seen in the connector end cap 80' variation of FIG. 18B that the channel-like formation of the head bosses 87' are modified to take the form of a solid projection. This stiffens the head bosses 87', making them comparatively stiffer during insertion into an end of channel 12, but also more robustly secured once in place.

Each boss pair 85,87,87' of each boss formation projects from the same respective side of plate 84. Again, the neck bosses 85 are sized and spaced so as to respectively and closely interface with inside faces of the base 14 and walls 17 of the channel neck portion N, and the head bosses 87,87' are sized and spaced so as to respectively and closely interface with inside faces of the step 15 and walls 19 of the channel head portion H.

It will also be seen that the plate 84 of the connector end cap 80,80' has an aperture 88 formed therethrough. This can allow e.g. the LED strip light 78 to be fed therethrough, form one channel to the next, as well as other services (e.g. cables, conduits, etc.).

FIG. 20 also shows a view similar to FIG. 19E (described later) in which the channel 12 has been located in the recess 42 of a panel 40, but where a terminating end cap 60' or connector end cap 80' has been located in one end of the channel (i.e. in the channel end facing away). Here, it will be seen how the solid formation of each head bosses 67',87' is able to better interface with surrounding wall portions (i.e. step 15, wall portion 19, lips 30 and 34) of the channel 12.

In FIG. 20, it will also be seen that an inside face of each head boss 67',87' generally aligns with the opposing lips 34 of the flanges 32. Likewise, an inside face of each neck boss 65,85 generally aligns with the opposing lips 34 of the flanges 32. Thus, collectively, the lips 34, neck bosses 65,85 and head bosses 67',87' define a channel into which e.g. a portion (e.g. upper corner) of the fin F can be received and retained.

Referring now to FIG. 12, the channel 12 can be replaced with an elongate member in the form of a closed hollow section 90. Section 90 has a similar external profile to that of channel 12. Thus, the section 90 can still be slide- or push/press-fit into the recess 42 of panel 40. However, the open end 25 of channel 12 is replaced with a closed wall 92. Further, to enable section 90 to be secured with respect to a structure, the closed wall 92 and the base wall 14' may each have apertures, pilot holes or other formations for fasteners (including for adhesives, or a mounting fixture, etc.).

Referring now to FIG. 13, the channel 12 can be modified to have a "diamond" profile 100. Again, the profile 100 has a neck portion N that extends to an enlarged head portion H, so that the profile 100 can still be slide- or push/press-fit into a suitably profiled recess of panel 40. The open end 102 of profile 100 comprises inwardly projecting lips 104 that each run for a length of the profile (e.g. for the entire length or for discrete length(s) thereof). The lips 104 are arranged to oppose and project towards each other. As with channel 12, the lips 104 are configured to retain the cover 70 to close over the open end 102 of profile 100, such as by a snap- or slide-fit. Further, to enable the profile 100 to be secured with respect to a structure, the base wall 14' can have apertures, pilot holes or other formations for respective fasteners (including for adhesives, or a mounting fixture, etc.).

Referring now to FIG. 14, the channel 12 can be modified to have a bulbous profile 110. The enlarged head portion H defines a "bulb" of the bulbous profile 110. An opening 112 of the profile 110 is defined at an opposite side (e.g. within the base 14") of the profile. Again, the profile 110 has a neck portion N that extends to the enlarged head (or bulb) portion H, so that the profile 110 can still be slide- or push/press-fit into a suitably profiled recess of panel 40.

The enlarged head portion H (bulb) of the bulbous profile 110 comprises a rebate 114 (i.e. at a location that opposes the opening 112). The rebate 114 comprises a wall 116 that runs for a length of the profile 110 (e.g. for the entire length or for discrete length(s) thereof). An LED strip light 78 can be secured to wall 116 to locate within the rebate 114.

Further, to enable the profile 110 to be secured with respect to a structure, the base wall strip portions 14" can have apertures, pilot holes or other formations for respective fasteners (including for adhesives, or a mounting fixture, etc.).

The system 10 as described herein can provide for "universal" panel mounting. In this regard, the system 10 can accommodate a range of panel widths (e.g. ranging from 4 mm to 150 mm panel thicknesses). The system 10 can also accommodate a range of panel lengths (e.g. more than two spaced channels 12 can be mounted with respect to a given structure to support very long panels).

Because each channel 12 can be suspended (e.g. spaced) or direct-fixed to a structure, the system can allow for quick and easy installation. The system 10 can be factory prefabricated in a factory (e.g. according to the specifications of a given site). The system 10 can be supplied as a kit (e.g. along with installation instructions). The kit can comprise one or more (typically two) channels, one or more panels, a set of covers, end caps and connectors, two mounting fixtures per channel (i.e. four/kit), each being as set forth above. The channels, covers, end caps, connectors and mounting fixtures of the kit may be supplied separately and without the panels. For example, panels may be pre-formed and supplied separately to other components of the kit.

The system 10 is modular, in that channels 12 and panels 40 can each easily be adapted (e.g. joined and/or resized) on site to suit the particular application, including by making use of the kit including the covers 70, terminating end caps 60 and connector end caps 80, as outlined above.

Referring now to FIGS. 19A to 19F, a method for mounting a panel as set forth above with respect to a structure will be described. The method can be employed to install one or a series of such panels using one or a series of elongate channels as set forth above. The method can be used to install such panel(s) at or in relation to a ceiling, ceiling space, false ceiling, wall, frame, divider, partition, border, fixture, furniture, etc. The panel to be installed can take the form of an acoustic panel, baffle or fin, but again is not so limited.

As illustrated by FIG. 19A, step 1 of the method comprises mounting a base wall 14 of the channel 12 with respect to the structure. Typically, two pre-suspended or pre-affixed mounting fixtures 50 are each connected to the base wall 14 in the manner as set forth above. The flexibility of suspension line 54 allows the head 59 of each mounting fixture 50 to be maneuvered to locate within the base recess 16 to be retained therein by the lips 18. When each mounting fixture 50 is pre-affixed into the structure (e.g. ceiling, wall, etc.), the recess 16 of channel 12 can be slid onto the head 59 thereof.

As illustrated by FIG. 19B, step 2 of the method comprises mounting a terminating end cap 60 into one end of the channel 12. In a variation, a connector end cap 80 can be mounted into one end of the channel 12.

As illustrated by FIG. 19C, step 3 of the method comprises locating the channel 12 within a panel recess 42 to secure each panel to a given channel (i.e. that has already been pre-mounted with respect to the structure). Typically, each panel 40 is lifted up and into engagement with the channel 12 (see arrow), with each channel 12 being push/press-fit into the recess 42 via the outer recess portion 45 (i.e. with the tapered walls 47 at the entranceway facilitating the passage and thus the push- or press-fit of the head H into the recess 42. In a variation, the channel 12 can be slid and/or snapped into the recess 42 (i.e. laterally from a side face of the panel 40, with the option of sliding and snapping-in taking place simultaneously).

FIG. 19D shows the channel 12 now located snugly with the recess 42, thereby retaining the panel with respect to the structure.

As illustrated by FIG. 19E, step 4 of the method comprises locating each discrete length of cover 70 (i.e. between adjacent panels in a multi-panel set-up) to close over the open end 25 of the channel 12. Each discrete length of cover 70 is typically retained by a snap- or slide-fit, with the flanges 74 interacting with respective lips 30 at the open end 25.

As illustrated by FIG. 19F, step 5 of the method comprises the mounting of another terminating end cap 60 into the opposite end of the channel 12. In a variation, a connector end cap 80 can be mounted into the opposite end of the channel 12, whereby further lengths of channel can be joined end-to-end.

As indicated above, it will be understood that steps of the method as described herein can be varied to accommodate differing numbers of channels, channel lengths, channel spacings, panels, panel lengths, panel widths and panel thicknesses. Also, a number of panels may be mounted to the channel(s) in a variable (rather than evenly) spaced manner, and a multi-channel spacing may be uneven. Thus, a given installation may comprise any number of variably spaced channels and any number of variably spaced and varying panels. Different combinations of channel and member types can also be employed.

It should also be understood that, whilst each panel 40 has been shown (and has been configured) to be mounted to each channel 12 in a generally orthogonal arrangement (i.e. each panel 40 is shown extending at a right angle to the longitudinal axis of each channel 12), the panel 40 can be reconfigured to mount at an angle other than ~90° to the longitudinal axis of each channel 12. Further, whilst each channel 12 has been depicted as being straight, one or more of the channels 12 may be curved, angled or generally non-linear, with the panel(s) and recesses 42 being reconfigured accordingly.

Each of the opposing channel sidewalls 13 is configured to define an outwardly projecting step-formation in the form of step 15 (i.e. at the juncture of the neck N with the head H). In the channel 12, walls 17 of neck N extend generally orthogonally from the base 14 to the step 15. The step 15 then projects laterally out from each wall 17. The head H comprises walls 19 that each extend from a respective step 15 at an acute angle to a distal end edge 21 of the wall 19. The distal end edges 21 are spaced to define an open end 25 of the channel 12. Alternatively, the walls of the head H can extend such that they are connected (e.g. as a continuous wall), instead of being spaced at their distal end edges (see e.g. the channel embodiments of FIGS. 12 & 14).

Referring now to FIGS. 21-24, a system 100 is shown which can provide a 'cloud' panel mounting arrangement. In its most basic form, the system 100 can comprise just one channel 12 (i.e. as set forth and described above) and just one panel 140 (i.e. similar to the panel 40 as set forth and described above). In this regard, the panel 140 can take the form of an acoustic panel (e.g. of a thermally bonded polymeric (such as polyester) fibre material or natural (such as wool) fibre material).

Figure 23:
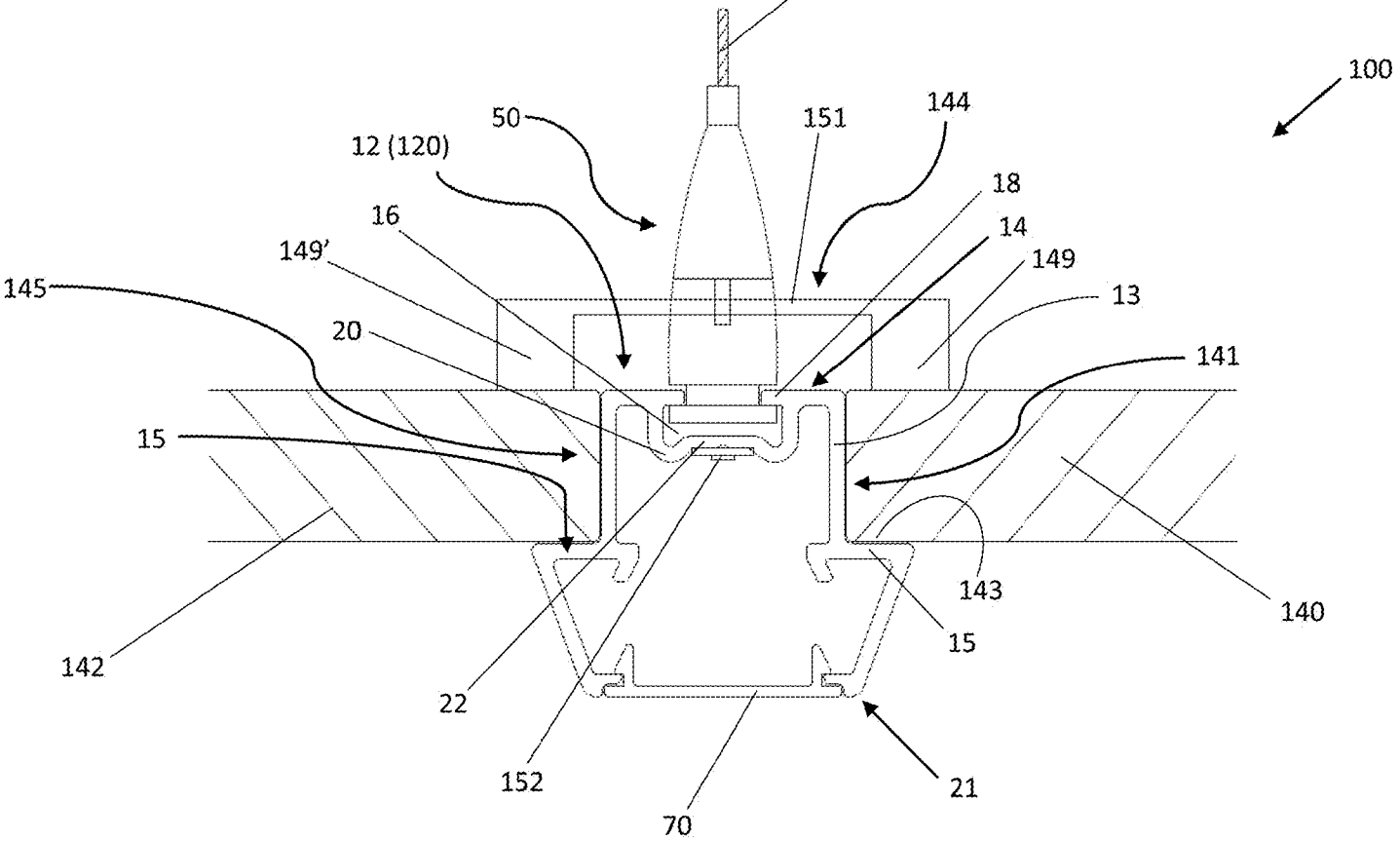
FIG. 23 shows a schematic sectional detail view of the system of FIGS. 21 & 22.

When channel 12 is employed to provide a cloud panel mounting arrangement, and as best shown in FIG. 23, a side edge 141 of the panel 140 can be located at (i.e. adjacent to or in abutment with) one of the channel sidewalls 13 (i.e. adjacent to the neck portion N). In addition, an in-use lower face 143 of the panel 140 can locate on, and be supported by, the step 15 (i.e. at the juncture of the neck N with the head H). Thus, the panel side edge 141 can, along its length, be supported by the channel 12. Initially, the panel 140 can simply locate on the step 15 under its own weight.

However, FIG. 23 also shows a clamping element in the form of a rotatable clamp 144. The clamp 144 is arranged to clamp and hold the panel side edge 141 against the channel 12 in use (i.e. to secure the panel 140 in its location on step 15). The functioning of clamp 144 is explained in further detail below.

Further, FIG. 23 shows a mounting fixture 50 (i.e. as set forth and described above). Again, the mounting fixture 50 is configured such that it can either be mounted directly to (e.g. by being affixed within) a structure (such as a ceiling, roof, false ceiling, etc.), or it can be suspended/spaced from the structure (e.g. ceiling, roof, false ceiling, etc.) via the suspension line 54.

In the basic form of system 100, just side edge 141 of panel 140 is supported at a single channel 12. An opposite side of panel 140 can be supported at some other structure, such as a post, panel, wall, etc. For example, the panel could span between a wall and the channel 12. However, typically the channel 12 and panel 140 form part of a suspended "cloud" system. These more complex forms of the system 100 will now be described.

In this regard, the system 100 can comprise a second panel 142. Panel 142 is similar to panel 140, although it is configured/shaped differently (i.e. in the embodiment of FIGS. 21-24). Further, the system 100 can comprise a second channel 12' that is arranged to be spaced apart from but parallel to the channel 12. An opposite side 145 of panel 140 can be supported at the channel 12', in a similar manner to the side 141, but at an opposing side of channel 12' to that of channel 12. Thus, in a more complex form, the system can comprise two channels 12,12' and either one panel 140, or two panels 140,142.

As best shown in FIG. 23, the panels 140 and 142 are configured to generally correspond to and nest (e.g. snugly or closely) at step 15. In this regard, the panels 140,142 each have a thickness such that, in use, they generally sit flush with the channel base 14. This allows the panels to interact more evenly with the clamp 144.

Additionally, in a yet more complex form, the system 100 can comprise parallel and spaced-apart transverse channels 120 and 120'. The transverse channels are each arranged to extend between the channels 12,12' as shown in e.g. FIGS. 21,22 & 24. In this regard, the ends of transverse channels 120,120' can extend from and between respective ends of the channels 12,12'. Thus, the channels 12,12',120,120' can be employed to form a square or rectangular mounting frame for supporting the first and second panels 140,142 in a cloud-type arrangement.

Figure 21:
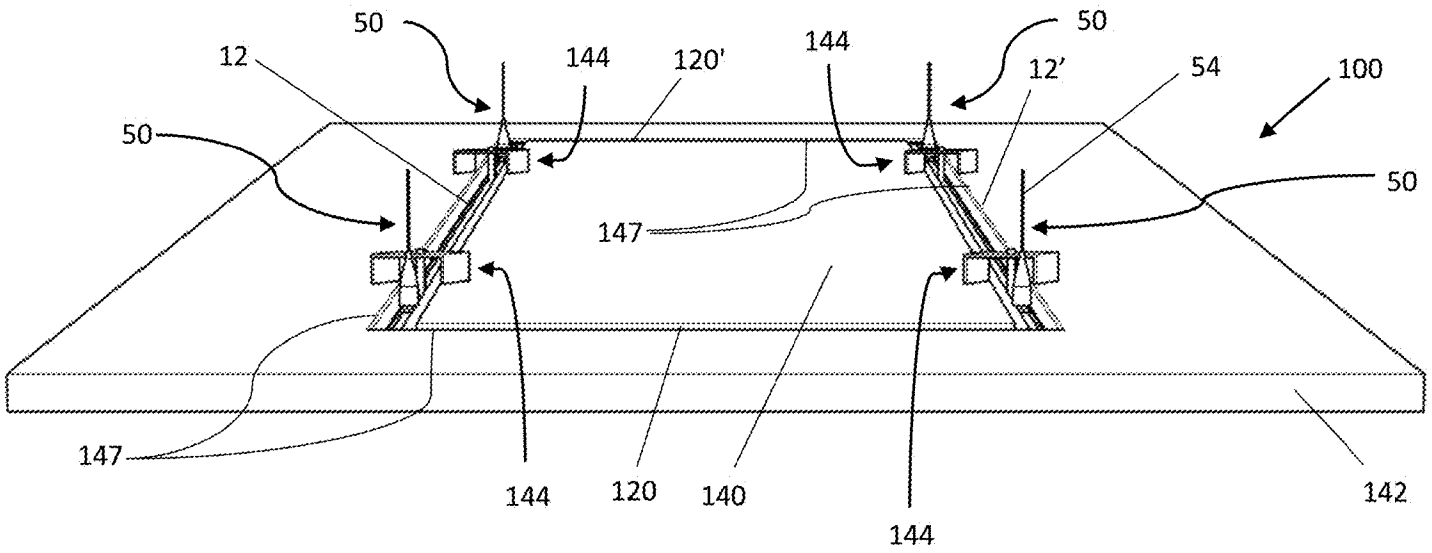
FIGS. 21 & 22 are respective upper and underside perspective views of an embodiment of a cloud panel system.
Figure 22:
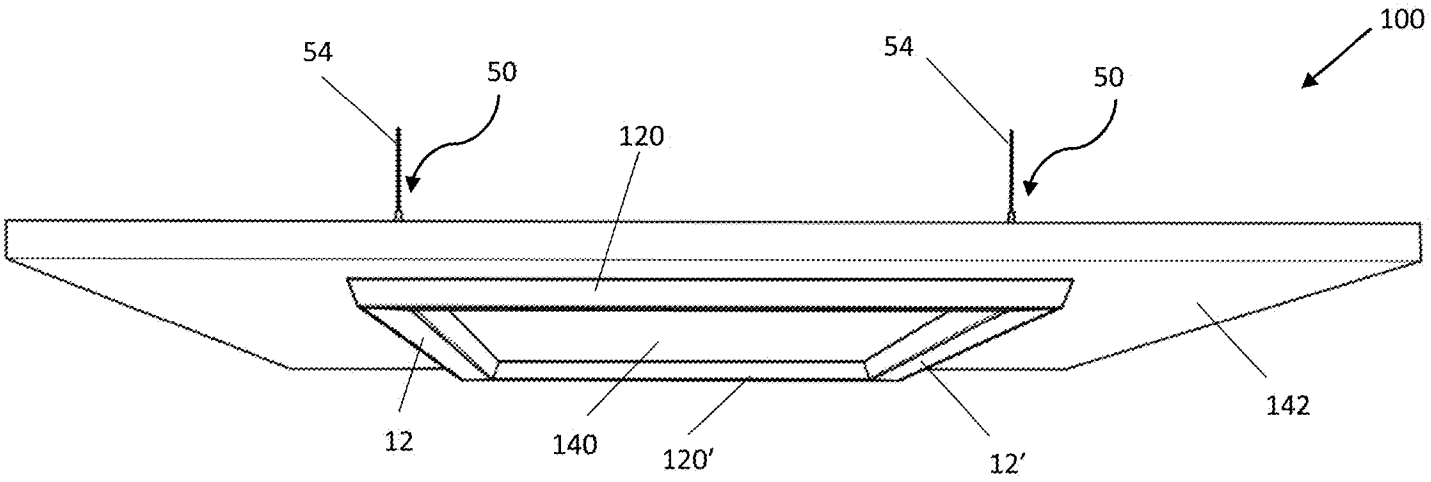

In this regard, in the embodiment of FIGS. 21-24, the opposing channels 120,120' are orientated generally at right-angles to the channels 12,12'. In FIG. 21, the ends of each channel 120, 120' are shown abutting at the end sides of the adjacent channels 12,12'. However, in a variation shown in FIGS. 22 & 24, the juncture between channels 12,12' and channels 120,120' are defined as mitre-joints (i.e. the terminal ends of channels 12,12' and 120,120' are each angled (e.g. cut) at 45° so as to form the 90° corner angle).

Further, in the embodiment of FIGS. 21-24, the panel 140 is configured with a square or rectangular shape to sit snugly within the mounting frame defined by channels 12,12',120, 120' in the cloud-type arrangement. Likewise, the panel 142 is configured with a central rectangular cut-out 147 to locate snugly on the outside of (i.e. to surround) the mounting frame defined by channels 12,12',120,120' in the cloud-type arrangement. Thus, each channel 12,12',120,120' supports a respective edge of panel 140 and panel 142 on either side thereof.

Further, it will be seen that a respective leg 149 and 149' of each clamp 144 is arranged to clamp and hold a respective side edge of the panels 140,142 against the channels 12,12'. In this regard, to hold the panels 140,142 in place within the mounting frame, only the channels 12,12' need be provided with a respective pair of spaced clamps 144.

Additionally, to suspend the mounting frame from a structure (e.g. ceiling, roof, false-ceiling, etc.), only the channels 12,12' need be provided with a respective pair of spaced mounting fixtures 50.

Figure 24:
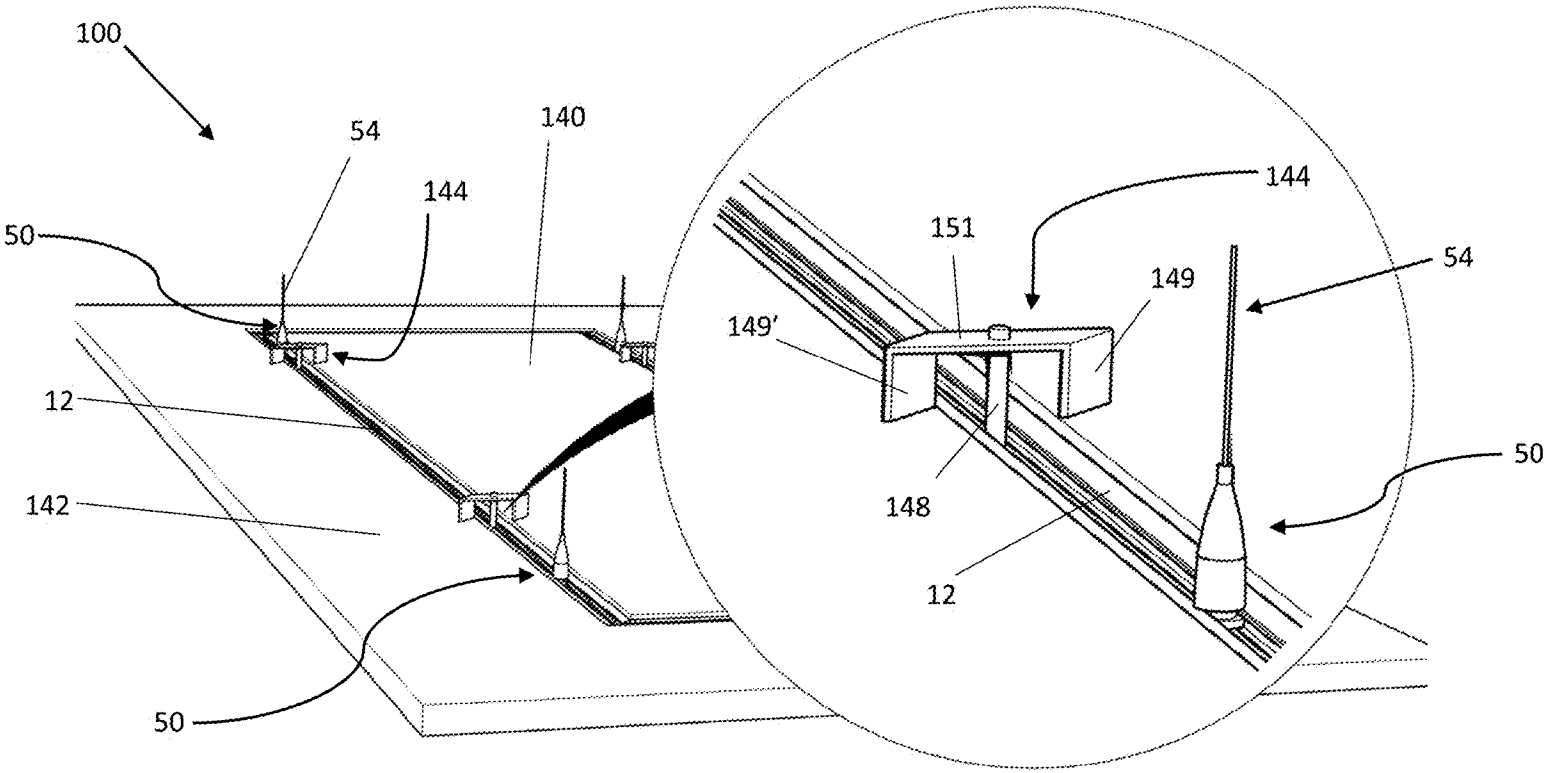
FIG. 24 is perspective view of the cloud panel system with a detailed view of the clamping fixture.

Referring in particular to FIGS. 23 and 24, it will be seen that each clamp 144 is in the form of a bracket defined by an elongate strip that is bent to assume a C-shaped cross-sectional profile. The bracket can be formed from a rigid material (e.g. a metal such as aluminium, or a plastic such as polycarbonate, etc.). The legs 149,149' of clamp 144 extend downwards from a central part 151 to project to and contact respective side edges of panels 140, 142. The central part 151 of clamp 144 is mounted at its center to channel 12,12' by a rod 148 (e.g. a pin, bolt, screw, etc.). An in-use lower end of each rod 148 is configured to locate in base recess 16 defined in the channel base 14 by opposing and inwardly projecting lips 18 (i.e. in a similar manner to the lower end of the mounting fixture 50).

In use, each clamp 144 can be rotated with respect to its rod 148 between a non-clamping orientation (i.e. legs 149, 149' sitting above a respective channel 12,12') and a clamping orientation (i.e. legs 149,149' sitting above a respective side edge of panels 140, 142). When each clamp is in the non-clamping orientation, the panels 140,142 can be dropped into place on the mounting frame. Thereafter, the clamps can be rotated into the clamping orientation to secure each panel 140,142 to its respective channel 12,12',120,120'. As best shown in FIG. 21, four clamps 144 are evenly spaced along the channels 12,12' to sufficiently secure panels 140,142 in place.

In a variation of the clamp 144, the in-use lower end of the rod 148 can be mounted to the base 14 of channels 12,12' as per the mounting fixture 50 described above. However, an opposing in-use upper end of the rod 148 can be externally threaded to engage with a corresponding internally threaded hole defined in the center of clamp central part 151. Thus, once each clamp 144 has been rotated into the clamping orientation (legs 149,149' above panels 140,142), the rod 148 can be rotated (e.g. screw-driven) relatively to the threaded hole of clamp central part 151, in a manner that drives the legs 149,149' down securely into the panels 140,142.

In the system 100, one or more of the channels 12,12', 120,120' can hold a source of light (e.g. an LED strip) and thereby release light in use. In the embodiment shown in FIG. 23, an LED strip light 152 is shown mounted (e.g. affixed, riveted, screwed, etc.) at the countersink 22 of the lower wall 20 defined within the channel 12. Further, a cover 70, formed of a light-transmissive material, can be installed at the distal end edges 21 of channel 12 to enable light to project outwards from system 100.

Typically, in-use, the system 100 hangs freely from a structure (e.g. ceiling, roof, etc.) in a substantially horizontal orientation, to function as a so-called cloud panel. However, it should be understood that, whilst the embodiments of system 100 are illustrated as generally horizontal, system 100 may be inclined at angles other than horizontal (i.e. at angles greater to or less than horizontal). Further, rather than being suspended, the system may be affixed to the underside of a ceiling, roof, etc.

It should be understood that, whilst the embodiments illustrated are rectangular in shape, the channels 12,12',120, 120' can be reconfigured (e.g. in length, number and angle of extent to other than ~90°) to form alternative, e.g. regular or irregular polygons (i.e. with irregular polygons having channels of unequal length). For example, embodiments of the mounting frame may comprise less or more than four channels 12,12',120,120' (e.g. three, five, six, seven, etc. channels) arranged as closed polygonal shapes. Further, whilst each channel 12,12',120,120' has been depicted as being straight, one or more of the channels may be curved or generally non-linear. The panels 140,142 can be reconfigured according to the shape of the mounting frame.

In another embodiment, the mounting frame may be configured to form an open body shape (as opposed to the closed body shape of FIGS. 21-24). For example, a first channel 12 can be arranged parallel to and spaced apart from a second channel 12', but without any channels 120,120' extending/connecting therebetween. In this open configuration, a single panel 140 is able to span between the first and second channels 12,12' (i.e. the panel is only supported at its opposite edges by the first and second channels 12,12', and not at its end edges). Such an open arrangement can, for example, also be used to span a ceiling, roof, etc.

Figure 25:
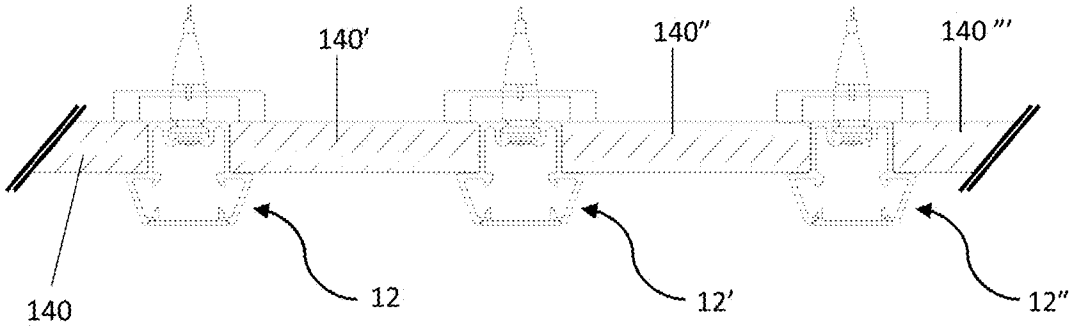
FIG. 25 shows a schematic sectional detail view of an alternative embodiment of the system of FIGS. 21 & 22.

In this regard, and as best shown in FIG. 25, a number of parallel channels 12,12',12" etc. can be provided (e.g. suspended or affixed in parallel), with respective panels 140, 140',140", 140'", etc. being located between opposing, adjacent panels across the span of the ceiling, roof, etc.

Figure 26B:
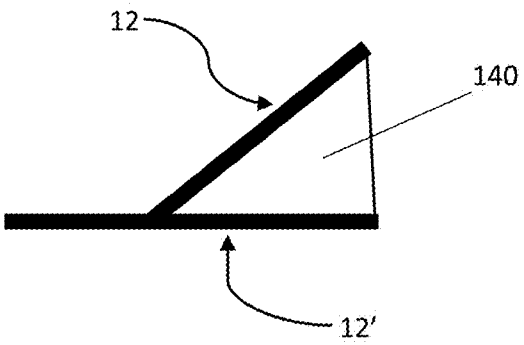
FIGS. 26A & 26B are schematic top views of the cloud panel system illustrating two variations of channel configuration.
Figure 26A:
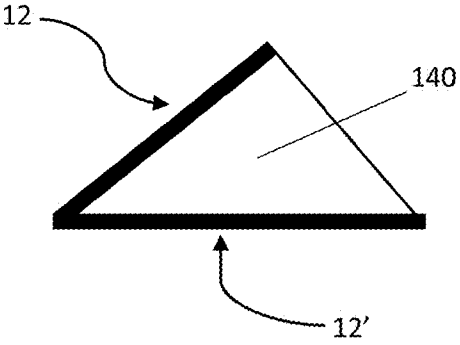

In another open mounting frame embodiment, a first channel 12 can be arranged at an angle to a second channel 12'. As best shown in FIGS. 26A and 26B, for example, the first channel 12 can be located at an end of the second channel 12', with either an end of the first channel 12 locating at the end of the second channel 12' (FIG. 26A), or an intermediate location of the first channel 12 locating at the end of the second channel 12' (FIG. 26B). In each case, a panel 140 is able to span between the first and second channels 12,12' but, in this case, only adjacent edges of the panel are supported at the first and second channels 12,12'.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the system and method as disclosed herein.

What is claimed is:

1. A system for mounting a panel such as an acoustic panel, baffle or fin, the system comprising:

an elongate member, a base of the member being configured to enable it to be mounted with respect to a structure, the configuration of the base comprising:

a planar wall continuous across a width of the base and configured so that the base can be mounted directly to the structure; or a wall having an opening whereby lips that project inwardly towards each other are defined by the opening, the lips being configured such that a mounting fixture can be located at and retained by the lips, with opposing sidewalls of the member extending from the base such that, in profile, the sidewalls define a neck portion that extends to an enlarged head portion of the member;

a panel having a recess formed in an edge thereof, the recess being configured to generally correspond to an external profile of the member whereby an inner recess portion is enlarged to snugly or closely receive the member head portion, with an outer recess portion being configured to receive the member neck portion, the outer recess portion opening out of the panel edge such that, when the member is located in the panel recess it is transverse to the panel and retains the panel to the member.

2. A system according to claim 1 wherein one or both of the member and the panel are configured whereby the member can be slid laterally through the recess and/or push-fit into the recess via the open outer recess portion.

3. A system according to claim 1 wherein the elongate member is in the form of an elongate channel, such that the base of the channel is configured to be mounted with respect to the structure, and such that the opposing sidewalls of the channel extend from the base to define the channel, each sidewall of the channel comprising an outwardly projecting step-formation at the juncture of the neck portion with the head portion, with sides of the recess of the panel being configured to define corresponding inwardly projecting step-formations at the juncture of the inner recess portion with the outer recess portion whereby, when the channel is located in the recess, the corresponding outwardly and inwardly projecting step-formations face each other to thereby enable retention of the panel to the channel.

4. A system according to claim 3 wherein the channel is configured such that the base extends between and joins the sidewalls of the channel, the sidewalls extending to a distal end edge such that the sidewalls are spaced to define an opening to the channel, with each sidewall distal end edge comprising an inwardly projecting lip that runs for a length of the sidewall, with the lips being configured to retain an elongate optionally strip-like cover at an opening to the channel, such as by a snap- or slide-fit.

5. A system according to claim 1, wherein a portion of the mounting fixture is configured to locate within the recess and be retained therein by the lips, and with another portion of the mounting fixture able to locate outside of the recess to project away from the base in use.

6. A system according to claim 5 wherein a wall of the recess is countersunk on an opposite side of the wall to the recess, the countersunk side extending for a length of the wall of the recess, such that an LED strip light may be located therein.

7. A system according to claim 1 wherein each sidewall further comprises an elongate flange that projects inwardly from an intermediate location of a respective sidewall, each flange extending for a length of a recess of the channel, with the flanges generally projecting towards each other, with each flange comprising a lip that extends at an acute angle from a distal end edge of the flange and away from the base.

8. A system according to claim 1 wherein the panel comprises a number of discrete recesses spaced out along the edge thereof, each for locating a respective member therein.

9. A system according to claim 1 wherein opposing inwardly-facing faces of the outer recess portion of the panel taper outwardly at the edge of the panel such that these inward faces are able to engage with corresponding external faces of the member sidewalls to thereby guide the member when it is push-fit into a respective recess of the panel via the open outer recess portion.

10. A system according to claim 1, the system further comprising an elongate cover which, when the member takes the form of a channel, is configured to be retained at an opening to the channel, the elongate cover comprising an elongate strip that has a pair of elongate, spaced parallel flanges projecting from and extending along a face thereof, with a distal end edge of each such flange being configured to interact with, such as by snap- or slide-fitting, a respective formation defined at a corresponding distal end edge of each sidewall, such that the elongate cover can be retained at and thereby cover the opening to the channel.

11. A system according to claim 1, the system further comprising at least one end cap, each end cap being configured for secure location at a respective end of the member such that, when the member is hollow, each end cap comprises a boss that protrudes from a plate, the boss having an external profile that generally corresponds to an internal profile of the hollow member, such that the end cap may be push-fit into the respective end of the member.

12. A system according to claim 11 wherein, when the member is hollow, each end cap takes the form of a connector that has bosses that protrude from respective, opposite sides of a plate, each boss having an external profile that generally corresponds to an internal profile of the hollow member, whereby each boss may be push-fit into an end of a respective hollow member such that the connector can extend between and connect hollow members end-to-end.

13. An elongate member for use with the system as set forth in claim 1, the elongate member being configured in the form of an elongate channel, such that a base of the channel is configured to be mounted with respect to the structure, and such that opposing spaced sidewalls of the channel extend from the base to define the channel, wherein the channel locates and houses a light source therewithin, and wherein the channel retains an elongate cover formed of a light-transmissive material at an opening to the channel located between the channel sidewalls.

14. A panel for use with a system for mounting the panel, the system including an elongate member, a base of the member being configured to enable it to be mounted with respect to a structure, with opposing sidewalls of the member extending from the base such that, in profile, the sidewalls define a neck portion that extends to an enlarged head portion of the member, the panel comprising at least one recess and being configured as set forth in claim 1.

15. A method for mounting a panel with respect to a structure, the method comprising:

i. providing an elongate member and a panel as set forth in claim 1;

ii. mounting the base of the elongate member with respect to the structure;

iii. mounting the panel to the member by way of locating the member in the panel recess such as by a relative sliding of the member laterally through the recess and/or by push-fitting the member into the recess via the open outer recess portion.

16. A method according to claim 15 wherein the panel comprises a number of discrete recesses spaced out along the edge thereof, wherein a number of members that correspond to the number of discrete panel recesses are mounted in a spaced manner with respect to the structure, and wherein a number of panels are mounted to the members, such as in a spaced manner.

17. A system for mounting a panel such as an acoustic panel, baffle or fin, the system comprising:

a first elongate member, a base of the first elongate member being configured to enable it to be mounted with respect to a structure, with opposing sidewalls of the first elongate member extending from the base such that, in profile, the sidewalls extend from the base to define a neck portion, the sidewalls projecting laterally out from the neck portion to define an outwardly projecting step-formation, each sidewall extending from its respective step-formation to an enlarged head portion of the first elongate member;

a first panel, the first panel arranged to be located adjacent to the first elongate member whereby an edge of the first panel locates adjacent to the neck portion of the first elongate member, and a face of the first panel locates adjacent to the head portion of the first elongate member; and one or more clamping elements, each clamping element arranged to apply a clamping force to a respective panel located at the first elongate member, the clamping force being applied at a face of the panel that is opposite to said face of the panel located at the head portion of the first elongate member, whereby the panel is clamped to the elongate member.

18. A system according to claim 17, the system further comprising a second panel, the second panel arranged to be located adjacent to an opposite side of the first elongate member to where the first panel is to be located, such that an edge of the second panel locates adjacent to the neck portion of the first elongate member, and a face of the second panel locates adjacent to the head portion of the first elongate member.

19. A system according to claim 17, the system further comprising a second elongate member, the second elongate member being located adjacent to the first elongate member but arranged so as to support another edge of the first panel at the neck portion of the second elongate member, with the face of the first panel locating adjacent to the head portion of the second elongate member, wherein the second elongate member is arranged:

i. parallel to and spaced apart from the first elongate member, such that the first panel is able to span between the first and second elongate members to be supported at opposite edges of the first panel; or ii. at an angle to the first elongate member, such that the first panel is able to span between the first and second elongate members whereby respective edges of the first panel are supported at the first and second elongate members.

20. A system according to claim 17, the system further comprising third and fourth elongate members, wherein the second elongate member is arranged to oppose and be spaced apart from the first elongate member, and wherein the fourth elongate member is arranged to oppose and be spaced apart from the third elongate member, and wherein the third and fourth elongate members extend between and join the first and second elongate members, with respective ends of the third elongate member being located at respective ends of the first and second elongate members, and with respective ends of the fourth elongate member being located at respective opposite ends of the first and second elongate members.

* * * * *